US007370949B2

(12) United States Patent
Shiho et al.

(10) Patent No.: US 7,370,949 B2
(45) **Date of Patent: *May 13, 2008**

(54) LIQUID SUPPLYING MEMBER, METHOD OF MANUFACTURING THE SAME, AND LIQUID EJECTION APPARATUS INCORPORATING THE SAME

(75) Inventors: Akihiko Shiho, Nagano (JP); Toshio Kumagai, Nagano (JP); Atsushi Kobayashi, Nagano (JP); Masanori Takemura, Nagano (JP); Hitoshi Matsumoto, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 328 days.

This patent is subject to a terminal disclaimer.

(21) Appl. No.: 10/892,314

(22) Filed: Jul. 16, 2004

(65) Prior Publication Data

US 2005/0083382 A1 Apr. 21, 2005

Related U.S. Application Data

(63) Continuation-in-part of application No. 10/830,091, filed on Apr. 23, 2004, now Pat. No. 7,273,271, which is a continuation-in-part of application No. 10/374,526, filed on Feb. 27, 2003, now abandoned.

(30) Foreign Application Priority Data

| | | |
|---|---|---|
| Feb. 28, 2002 | (JP) | P2002-053905 |
| Feb. 3, 2003 | (JP) | P2003-026154 |
| Apr. 24, 2003 | (JP) | P2003-120528 |
| Jul. 17, 2003 | (JP) | P2003-198792 |
| Jul. 17, 2003 | (JP) | P2003-198795 |
| Jul. 17, 2003 | (JP) | P2003-198796 |
| Jul. 17, 2003 | (JP) | P2003-198798 |
| Jul. 18, 2003 | (JP) | P2003-199070 |
| Jul. 22, 2003 | (JP) | P2003-199882 |

(51) Int. Cl.
*B41J 2/175* (2006.01)

(52) U.S. Cl. ..... 347/85

(58) Field of Classification Search ..... 347/65, 347/85–86, 87; 138/111, 115, 118, 137, 138/139

See application file for complete search history.

(56) References Cited

U.S. PATENT DOCUMENTS 4,334,234 A * 6/1982 Shirato et al. ..... 347/65

(Continued)

FOREIGN PATENT DOCUMENTS

JP 60-232964 11/1985

(Continued)

OTHER PUBLICATIONS

Patent Abstracts of Japan, Publication No. 2001-212974, Publication Date Jul. 8, 2001, Ink-Jet Type Recording Apparatus and Method for Replenishing Ink to Sub Tank in the Apparatus.

(Continued)

*Primary Examiner*—Anh T. N. Vo
(74) *Attorney, Agent, or Firm*—Sughrue Mion, PLLC

(57) ABSTRACT

In a liquid supplying member, for supplying liquid from a liquid container to a liquid ejection head which are provided in a liquid ejection apparatus, a plurality of elastic members, each of which is elongated in a first direction so as to have a first face and a second face, are arrayed in a second direction perpendicular to the first direction. A first film member is joined to the first face of each of the elastic members. A second film member is joined to the second face of each of the elastic members, such that a passage, through which the liquid is supplied from the liquid container to the liquid ejection head, extending in the first direction is hermetically defined between the adjacent elastic members by inner faces of the first film member and the second film member.

29 Claims, 25 Drawing Sheets

U.S. PATENT DOCUMENTS

| | | | | | |
|---|---|---|---|---|---|
| 4,981,760 | A | | 1/1991 | Naito et al. | |
| 5,025,270 | A | | 6/1991 | Umezawa | |
| 5,043,764 | A | * | 8/1991 | Arnold et al. | 399/59 |
| 5,473,354 | A | | 12/1995 | Arquilevich et al. | |
| 5,602,577 | A | | 2/1997 | Shibata et al. | |
| 5,933,169 | A | * | 8/1999 | Sugahara | 347/71 |
| 5,988,801 | A | | 11/1999 | Coiner | |
| 6,024,441 | A | * | 2/2000 | Nishimoto | 347/85 |
| 6,068,370 | A | | 5/2000 | Miller et al. | |
| 6,109,738 | A | * | 8/2000 | Miyata et al. | 347/71 |
| 6,719,414 | B2 | * | 4/2004 | Sole et al. | 347/85 |
| 7,201,475 | B2 | * | 4/2007 | Shiho et al. | 347/85 |
| 2005/0140752 | A1 | * | 6/2005 | Shiho et al. | 347/85 |

FOREIGN PATENT DOCUMENTS

| | | | |
|---|---|---|---|
| JP | 6-000746 | U | 1/1994 |
| JP | 6-198903 | A | 7/1994 |
| JP | 7-314719 | | 12/1995 |
| JP | 9/300652 | | 11/1997 |
| JP | 2001-026119 | A | 1/2001 |
| JP | 2001-38922 | A | 2/2001 |
| JP | 2003-127411 | | 5/2003 |

OTHER PUBLICATIONS

Patent Abstracts of Japan, Publication No. 11-192720, Publication Date Jul. 21, 1999, Ink Jet Recorder, Ink Filling Method and Ink Supplying Method.

* cited by examiner

LIQUID SUPPLYING MEMBER, METHOD OF MANUFACTURING THE SAME, AND LIQUID EJECTION APPARATUS INCORPORATING THE SAME

This is a continuation-in-part application of U.S. patent application Ser. No. 10/830,091 filed on Apr. 23, 2004 now U.S. Pat. No. 7,273,271, which is a continuation-in-part application of U.S. patent application Ser. No. 10/374,526 filed on Feb. 27, 2003 now abandoned. Applications Ser. Nos. 10/830,091 and 10/374,526 are incorporated herein by reference in their entirety, and so are all of the Japanese patent applications from which priority is claimed, namely: 2002-053905 filed Feb. 28, 2002; 2003-026154 filed Feb. 3, 2003; 2003-120528 filed Apr. 24, 2003; 2003-198792 filed Jul. 17, 2003; 2003-198795 filed Jul. 17, 2003; 2003-198796 filed Jul. 17, 2003; 2003-198798 filed Jul. 17, 2003; 2003-199070 filed Jul. 18, 2003; and 2003-199882 filed Jul. 22, 2003.

BACKGROUND OF THE INVENTION

The invention relates to a liquid supplying member for supplying liquid contained in a liquid cartridge to a liquid ejection apparatus for effecting recording or printing operation. The invention also relates to a method of manufacturing such a liquid supplying member.

For instance, the liquid ejection apparatus, such as an ink jet recording apparatus, subjects an object to recording or printing by ejecting liquid to the object while a liquid ejection head is reciprocally actuated. Liquid to be ejected to the object (e.g., ink) is supplied from a liquid container (e.g., a liquid cartridge) to a liquid ejection head (e.g., a recording head).

In addition to the liquid ejection apparatus of the type having both a liquid ejection head and a liquid container mounted on a carriage that travels reciprocally, a liquid ejection apparatus of another type having only a liquid ejection head mounted on a carriage (off-carriage type) is also available as disclosed in Japanese Patent Publication No. 2001-212974A, for example.

In such an ejection apparatus of the off-carriage type, as the printer size (printable sheet size) is larger, a length of the drawing of the ink supplying tube is longer, and the dynamic loss (pressure loss) is larger in the liquid supplying tube ranging from the ink tank to the carriage. This necessitates the use of an ink supplying tube having a large inside diameter for each ink supplying tube.

In addition, most of the ink supplying tubes used in the off-carriage type apparatus have each an annular cross section. Accordingly, its flexural rigidity is basically large. Further, when the ink supplying tube having a large inside diameter is employed, the flexural rigidity of the tube is further increased. Accordingly, to overcome the flexural rigidity of the tube, the necessity arises of further increasing a driving force for the carriage. With increase of the flexural rigidity, the tube must be designed to have a large bending diameter. In any case, the result is a further size increase of the apparatus.

The ink supplying tube involves the following problems. It is necessary to suppress evaporation of water content as a major component of the ink solvent. Further, air is dissolved into the ink in the ink supplying tube to thereby reduce a degree of degassing in the ink. To cope with this, one may take a measure of increasing the thickness of the ink supplying tube. Where the tube thickness increase measure is taken, the flexural rigidity of the tube is more increased.

To improve the anti-water permeability and gas barrier properties of the ink supplying tube, there is a proposal to use two or more layers to construct the ink supplying tube. Where a multi-layer construction is introduced into the tube annular in cross section, it is basically unavoidable to increase the flexural rigidity. Where the measure to use two or more layers for the tube is employed, metal molds must be respectively used for forming those layers in the extrusion molding machine. This results in increase of cost to manufacture.

SUMMARY OF THE INVENTION

It is therefore an object of the present invention to provide a liquid supplying member in use for the liquid ejection apparatus in which a flexural rigidity of the ink supplying tube is reduced, and satisfactory anti-water permeability and gas barrier properties are realized at low cost, and to provide a liquid ejection apparatus provide with the liquid supplying tube.

It is also an object of the invention to provide a liquid supplying member in which the liquid ejection apparatus body can be made compact and the attaching operation of the liquid supplying member can be facilitated.

It is also an object of the invention to provide a method of manufacturing such a liquid supplying member, and a liquid ejection apparatus incorporating such a liquid supplying member.

In order to achieve the above objects, according to the invention, there is provided a liquid supplying member, for supplying liquid from a liquid container to a liquid ejection head which are provided in a liquid ejection apparatus, comprising:

an elastic member, elongated in a first direction so as to have a first face and a second face; and a film member, joined to the first face and the second face such that a passage, through which the liquid is supplied from the liquid container to the liquid ejection head, extending in the first direction is hermetically defined by an inner face of the film member and the elastic member.

According to the invention, there is also provided a liquid ejection apparatus in which the above liquid supplying member is extended from the liquid container to the liquid ejection head.

According to the invention, there is also provided a liquid supplying member, for supplying liquid from a liquid container to a liquid ejection head which are provided in a liquid ejection apparatus, comprising:

a plurality of elastic members, each of which is elongated in a first direction so as to have a first face and a second face, the elastic members being arrayed in a second direction perpendicular to the first direction;

a first film member, joined to the first face of each of the elastic members; and a second film member, joined to the second face of each of the elastic members, such that a passage, through which the liquid is supplied from the liquid container to the liquid ejection head, extending in the first direction is hermetically defined between the adjacent elastic members by inner faces of the first film member and the second film member.

According to the invention, there is also provided a liquid ejection apparatus in which the above liquid supplying member is extended from the liquid container to the liquid ejection head.

In such configurations, a liquid supplying member in which the flexural rigidity is reduced can be provided with simple structure.

Preferably, the elastic member is formed with a recessed portion such that a width of the passage is enlarged thereat. The recessed portion is situated closer to the liquid ejection head than the liquid container.

With such a configuration, the recessed portion serves as a buffer which absorbs pressure fluctuation in liquid due to acceleration caused by the reciprocal movement of the liquid ejection head. Accordingly, it is not necessary to provide an additional buffer member in the ejection head side. In a case where the film member has flexibility, such a buffering function is further enhanced.

Preferably, the film member comprises an inner layer having a first permeability for gas and water, and an outer layer having a second permeability for gas and water which is less than the first permeability.

With such a configuration, the barrier property for gas and water can be attained with lower manufacturing cost in comparison with a case where the annular ink supplying tube is rendered to have such multi-layered structure.

Preferably, the elastic member is comprised of elastomer. With such a configuration, it is easier to heat-weld the film member to the elastic member. Therefore, the manufacturing cost can be reduced.

Preferably, a connector having a higher rigidity than the elastic member, and having an opening communicated with the passage is provided at each end of the elastic member.

Preferably, the liquid supplying member is flexed such that either the first film member or the second film member faces inwards.

According to the invention, there is also provided a liquid supplying member, for supplying liquid from a liquid container to a liquid ejection head which are provided in a liquid ejection apparatus, comprising:

a flexible base member, having a first face in which a plurality of first grooves are arrayed in a first direction; and a first flexible plate member, joined to the first face of the base member so as to seal the first grooves to form liquid supplying passages.

Preferably, each of the first grooves is formed with a through hole extending to a second face of the base member which is opposite to the first face.

With such a configuration, since a single liquid supplying member enables supply of a plurality of types of liquids, the liquid supplying member can be routed in a compact manner within the liquid ejection apparatus. Accordingly, the liquid ejection apparatus can be made compact.

Preferably, the base member is comprised of a thermoplastic elastomer. In this case, injection molding can be adopted to form the base member. Consequently, the liquid supplying member can be manufactured inexpensively, and alternatives of shape of the liquid supplying member can be easily increased.

Here, it is preferable that: the thermoplastic elastomer is comprised of polypropylene; and the first plate member comprises a first layer which is joined to the first face of the base member and comprised of at least one of polypropylene and polyethylene. In this case, the base member and the first plate member can be welded together.

It is further preferable that the first plate member comprises a second layer comprised of metal. In this case, even when another layer of the first plate member has enabled permeation of liquid, the metal layer prevents evaporation of the liquid. Further, even when another layer of the elongated plate member has enabled permeation of exterior air, the metal layer prevents intrusion of outside air into liquid.

It is further preferable that the first plate member comprises a third layer comprised of polyamide and a fourth layer comprised of polyethylene terephthalate, between which the second layer is sandwiched. In this case, not only the metal layer is protected, but also the strength of the first plate member is enhanced.

The liquid supplying member may further comprise a second flexible plate member which is joined to a part of the second face and comprised of a metal layer. In this case, even when liquid has permeated through the base member, the metal layer prevents evaporation of liquid.

It is also preferable that: the liquid supplying member comprises a first portion to be flexed and a second portion not to be flexed; and the first portion has a first thickness and the second portion has a second thickness thicker than the first thickness. In this case, the liquid supplying member can be readily flexed, while the quantity of liquid permeating through the base member in the thickness direction becomes smaller.

Preferably, a portion of the base member corresponding to at least the first portion has a cross section curved in a direction that the liquid supplying member is to be flexed. In this case, the liquid supplying member can be routed in the liquid ejection apparatus more compactly.

Preferably, the second face of the base member is formed with a plurality of second grooves arrayed in the first direction and sealed by a second flexible plate member.

Here, it is preferable that each one of the first grooves is communicated with associated one of the second grooves.

It is also preferable that each of the second grooves is formed with a through hole extending to the first face.

In the above configurations, alternatives in a direction in which the liquid supplying member is connected to the outside can be increased.

The liquid supplying member may further comprise a connector having a higher rigidity than the base member and communicating the first grooves and the liquid ejection head. In this case, attachment of the liquid supplying member is performed easily. Here, it is preferable that the connector and the base member are monolithically formed.

A cross-sectional area of each of the first grooves may be partly changed. For example, the base member includes a first portion that an extending direction of the liquid supplying member is changed, and the cross-sectional area is reduced at the first portion. Alternatively, the base member includes a first portion in which the cross-sectional area is enlarged so as to temporarily store liquid supplied from the liquid container. Here, a detector may be disposed at the first portion to detect that an amount of ink remaining in the first portion is a predetermined level or less.

Preferably, the base member is curved such that both longitudinal ends are opposed to each other in the vicinity of a longitudinal center portion thereof, in an original state. In this case, injection molding can be preferably adopted to form the base member.

Preferably, a thickness of the first plate member is substantially identical with a thickness of the base member. In this case, since the deforming amount of the joining surface between the first plate member and the base member becomes relatively small, they are hardly peeled from each other.

In order to attain the same advantage, the liquid supplying member further comprises a second flexible plate member, having a second face in which a plurality of second grooves are arrayed in the first direction. A face of the first plate member opposite to a face joined to the base member is joined to the second face of the second plate member so as to seal the second grooves.

Preferably, the liquid supplying member further comprises a second flexible plate member, having a thickness which is identical with a thickness of the base member and joined to a face of the first plate member which is opposite to the face to which the base member is joined. The first plate member is comprised of a metal layer. In this case, in addition to the above advantage, the evaporation of the ink solvent and the invasion of the external air can be effectively prevented.

Preferably, a part of the base member is branched such that each of branched portion includes at least one of the first grooves. In this case, the design freedom for arranging the liquid supplying member can be enhanced.

Preferably, a longitudinal elastic coefficient of the first plate member is higher than a longitudinal elastic coefficient of the base member. In this case, the first plate member can be easily bent such an extent that the first plate member comes in contact with the bottom of the grooves, thereby closing the liquid supplying passages.

According to the invention, there is also provided a method of manufacturing a liquid supplying member for supplying liquid from a liquid container to a liquid ejection head provided in a liquid ejection apparatus, the method comprising steps of:

providing a mold for forming a base member having a first face in which a plurality of first grooves are arrayed in a first direction;

injecting molten thermoplastic elastomer into the mold to form the base member having a flexibility; and joining a flexible plate member to the first face of the base member so as to seal the first grooves to form liquid supplying passages.

With such a configuration, the liquid supplying member can be manufactured inexpensively.

It is preferable that: the mold is configured such that the base member is curved such that both longitudinal ends are opposed to each other in the vicinity of a longitudinal center portion thereof; and the thermoplastic elastomer is injected from portions of the mold corresponding to the both longitudinal ends and the longitudinal center portion.

In this case, even when the liquid supplying member is long, the base member can be formed through injection molding.

According to the invention, there is also provided a liquid ejection apparatus in which the above liquid supplying member is extended from the liquid container to the liquid ejection head.

Preferably, the liquid supplying member is flexed such that either one of the base member or the first plate member having a higher elasticity than the other faces inwards.

Here, the bending direction is preferably a direction in which any one having higher elasticity from among the base member and the elongated plate member becomes contracted. Such a configuration enables an improvement in durability of the liquid supplying member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
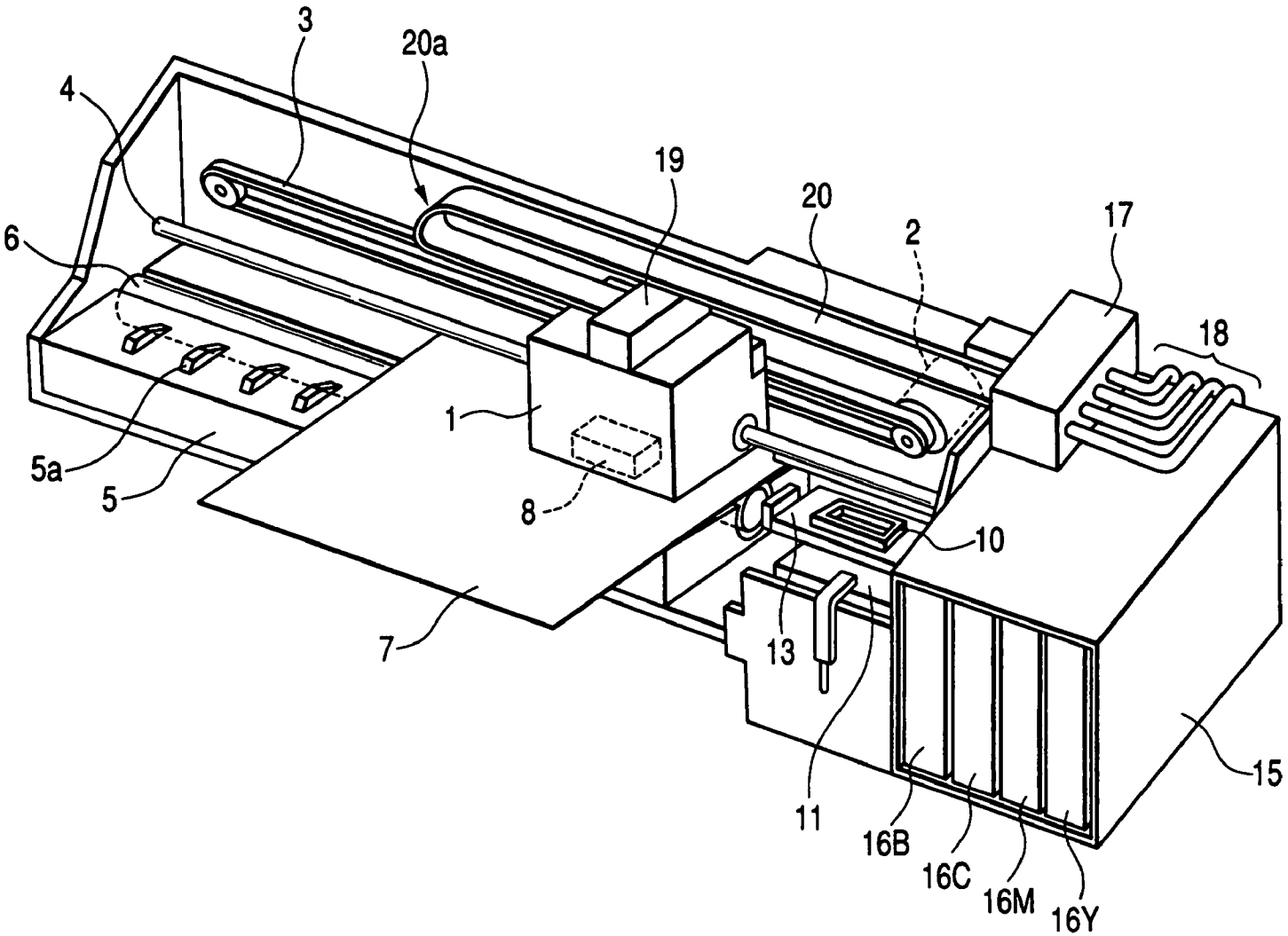
FIG. 1 is a perspective view showing an overall construction of a liquid ejection apparatus incorporating a liquid supplying member according to a first embodiment of the invention.

FIG. 1 shows an ink jet recording apparatus as an example of a liquid ejection apparatus incorporating a liquid supplying member according to a first embodiment of the invention. In the recording apparatus, a carriage 1 is reciprocatively moved in the primary scanning direction which extends along a longitudinal direction of a sheet feeder 5, while being guided by a guide member 4 with the aid of a timing belt 3 driven by a carriage motor 2.

The sheet feeder 5 is provided with a sheet feeding roller 6. A recording sheet 7, nipped between the sheet feeding roller 6 and a follower roller (not shown), is transported by rotation of the sheet feeding roller 6 in a secondary scanning direction orthogonal to the primary scanning direction. A number of protrusions 5*a* are intermittently arrayed in the longitudinal direction on the upper face of the sheet feeder 5. The recording sheet 7 is transported along the top faces of the thus arrayed protrusions 5*a*.

An ink jet recording head 8, as indicated by a dashed line, is mounted on the lower face of the carriage 1, which faces the recording sheet 7. The recording head 8 ejects ink drops onto the recording sheet 7 at proper timings according to print data so as to print an image on the recording sheet 7.

A capping device 10 is disposed in a non-printing region (home position). When the recording head 8 moves to just above the capping device 10, the capping device 10 moves upward and seals a nozzle formation face of the recording head (the bottom face of the recording head 8 in this embodiment). A suction pump 11 for applying a negative pressure to the inner space of the capping device 10 is disposed under the capping device 10.

During a period that the recording device is deactivated, the capping device 10 serves as a nozzle cover which suppresses evaporation of the ink solvent. At the same time, a cleaning operation for the maintenance of the recording head on its ink drop ejecting function is also performed in a manner that a negative pressure is applied from the suction pump 11 to the recording head 8 to thereby suck ink from the recording head.

As shown in FIG. 1, a strip-shaped wiper 13 made of an elastic material such as rubber is disposed in a printing region adjacent to the capping device 10. When the carriage 1 is reciprocatively moved to the capping device 10, the wiper 13 horizontally moves to and from the moving path of the recording head as required, and wipes the nozzle formation face of the recording head 8 to clean the surface.

As shown in FIG. 1, a tank holder 15 is provided on the side end (right end in FIG. 1) of the apparatus. Ink tanks are removably attached to the tank holder 15 from the front side of the apparatus. The ink tanks are a black ink tank 16B for supplying black ink, and color ink tanks 16C, 16M and 16Y for supplying color ink of cyan, magenta, and yellow.

Ink supplying pipes 18 are connected the tank holder 15 on which those ink tanks are mounted to a first connector 17 mounted on the upper side of the tank holder 15. The respective colors of ink are supplied from the respective ink tanks to the first connector 17 through the ink supplying pipes 18.

In the embodiment, an outer case of each ink tank, not shown in particular, is hermetically constructed. A flexible ink pack filled with ink is contained in each tank case. A pressurized air is supplied to the outer case forming the ink tank, whereby the ink is pushed out by the pressurized air.

A second connector 10 is mounted on the upper side of the carriage 1. The ends of an ink supplying tube 20 are connected to the first and second connectors 17 an 19 with the aid of connection members to be described later, respectively. With such an mechanical arrangement, the respective colors of ink are supplied from the ink tanks to the carriage side, and the recording head 8 ejects ink drops onto the recording sheet 7 in accordance with print data.

In the embodiment, an elongated flat tube is adopted as the ink supplying tube 20. A belt-shaped flat portion of the ink supplying tube 20 is laterally extended from the first connector 17 such that belt-shaped flat faces are made horizontal. The ink supplying tube 20 is returned horizontally via a U-shaped bent portion 20*a* and connected to the second connector 19. In accordance with the movement of the carriage 1, the bent portion 20*a* accordingly moves along the longitudinal direction of the ink supplying tube 20.

Figure 2:
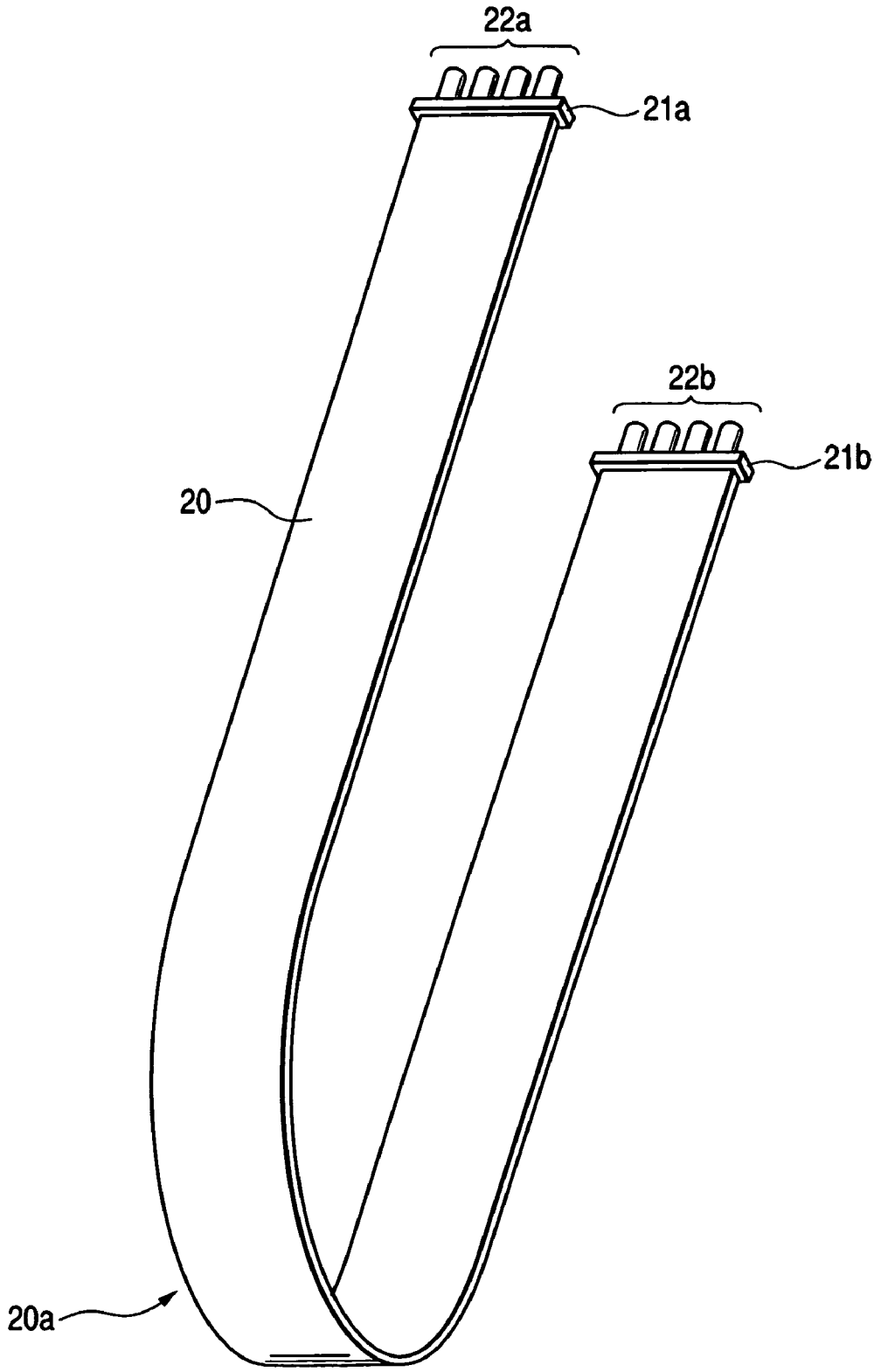
FIG. 2 is a perspective view of the liquid supplying member.

As shown in FIG. 2, first and second connection members 21*a* and 21*b*, made of synthetic resin, are attached to the ends of the ink supplying tube 20, respectively. In the embodiment, an arrangement is made to supply the respective colors of ink from the four ink tanks 16B, 16C, 16M and 16Y to the recording head 8. Accordingly, four cylindrical connection pipes 22*a* and 22*b* are formed on the first connection members 21*a* and 21*b*.

The connection pipes 22*a* formed on the first connection member 21*a* are connected to the first connector 17 shown in FIG. 1, and the four connection pipes 22*b* formed on the second connection member 21*b* are connected to the second connector 19 shown in FIG. 1. With such a configuration, the respective colors of ink are supplied to the recording head 8 mounted on the carriage 1.

Figure 3:
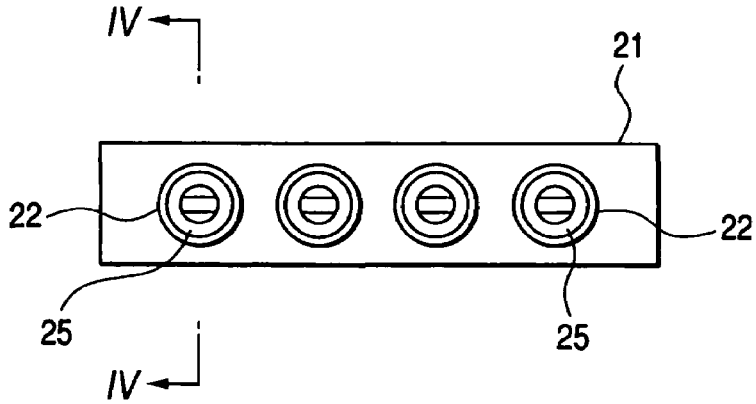
FIG. 3 is an enlarged, front view showing an end portion of the liquid supplying member of FIG. 2.

FIG. 3 shows the first and second connection members 21*a* and 21*b* when viewed from the end thereof. The first and second connection members 21*a* and 21*b* are configured to have the same shape. In this sense, those connection members are designated generally by a reference numeral 21 in FIGS. 3 to 6. The cylindrical connection pipes formed on the connection members are also designated generally by a reference numeral 22.

Figure 5:
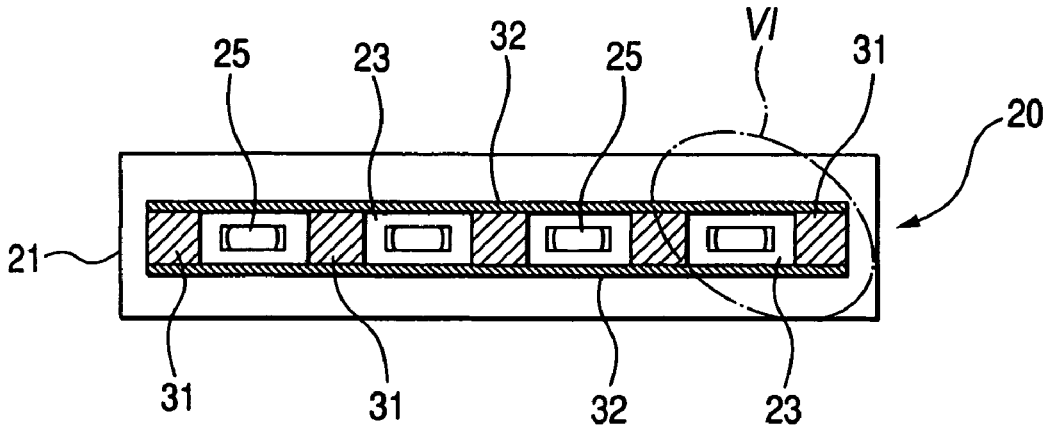
FIG. 5 is a section view taken along a line V-V in FIG. 4.

As shown in FIG. 5, the ink supplying tube 20 contains five elongated elastic members 31, made of elastomer, which are arrayed at regular intervals and extending in parallel.

Elongated film members 32 are hermetically joined to upper and lower faces, of the elastic members 31 by heat welding process.

Figure 6:
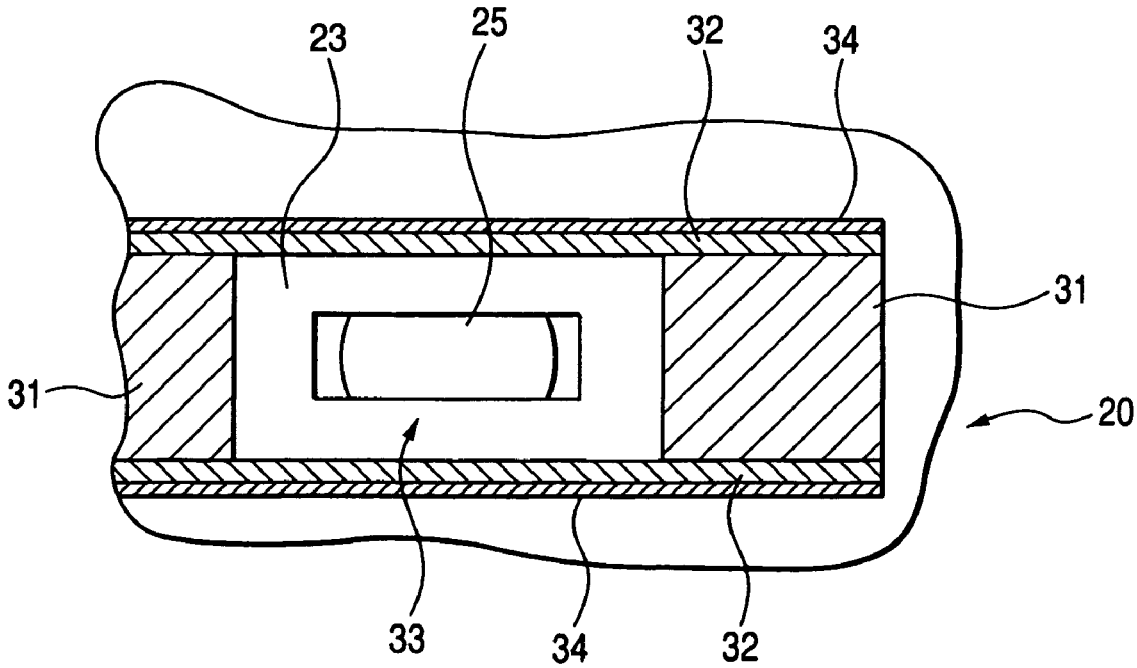
FIG. 6 is an enlarged view of a part VI in FIG. 5.

Four spaces, which are defined by the adjacent elastic members 31 and the upper and lower film members 32, are used as ink supplying passages 33 as shown in FIG. 6. In other words, those ink supplying passages 33 are partitioned by the elastic members 31. With use of elastomer in particular for the elastic members 31, the heat welding of a synthetic resin material constituting the elastomer to a synthetic resin material forming the film members 32 is made easy. Execution of the heat welding ensures a good hermeticity thereat.

In this case, a relatively elastic material may be selected for the elastomer. Accordingly, the flat face of the ink supplying tube 20 may smoothly be bent as shown in FIGS. 1 and 2. As a result, a degree of resistance of the ink supplying tube 20 to the reciprocal motion of the carriage 1 is remarkably reduced. As shown in FIG. 6, thin films 34 are formed, in advance, on the surfaces of the film members 32 by an aluminum lamination process. With the use of the thin films 34, the gas barrier properties and the anti-water permeability of the ink supplying tube are effectively given to the ink supplying tube 20.

Figure 4:
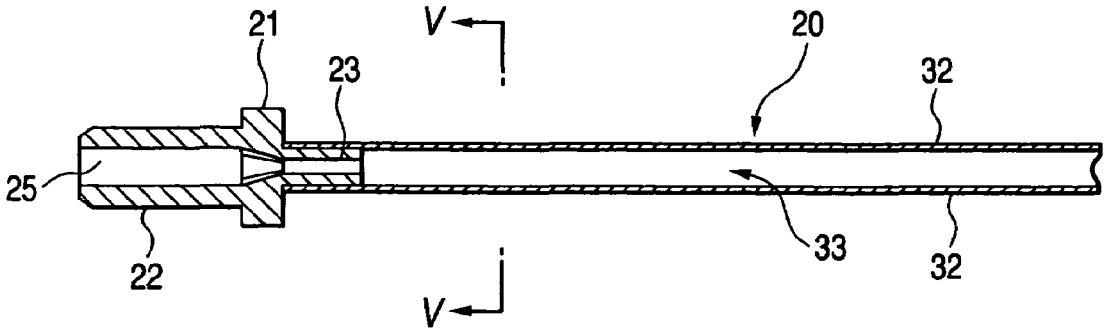
FIG. 4 is a section view taken along a line IV-IV in FIG. 3.

As shown in FIGS. 3 and 4, the connection member 21, which is mounted on each end of the ink supplying tube 20, includes a prism-shaped connection pipe 23 which is located at a position opposed to each cylindrical connection pipe 22. Openings 25 are formed in the connection member 21 while passing through the connection pipes 22 and 23. The connection pipe 23 is communicatively connected to the ink supplying passage 33 at each end of the ink supplying tube 20.

The connection pipe 23 is press-fitted into the space between the adjacent elastic members 31, and the film members 32 is heat welded to the upper and lower faces of the connection pipe 23 as shown in FIG. 6. The side faces of the connection pipe 23 to be press-fitted are preferably coated with adhesive in advance. By so doing, satisfactory hermeticity is kept between the side faces of the connection pipe 23 and the elastic members 31 after the fitting. In an alternative, the film member 32 is made of resin having the compatibility to the elastomer of the elastic material 31, and is made to integral with the elastic material 31 by insertion molding, for example.

Figure 7:
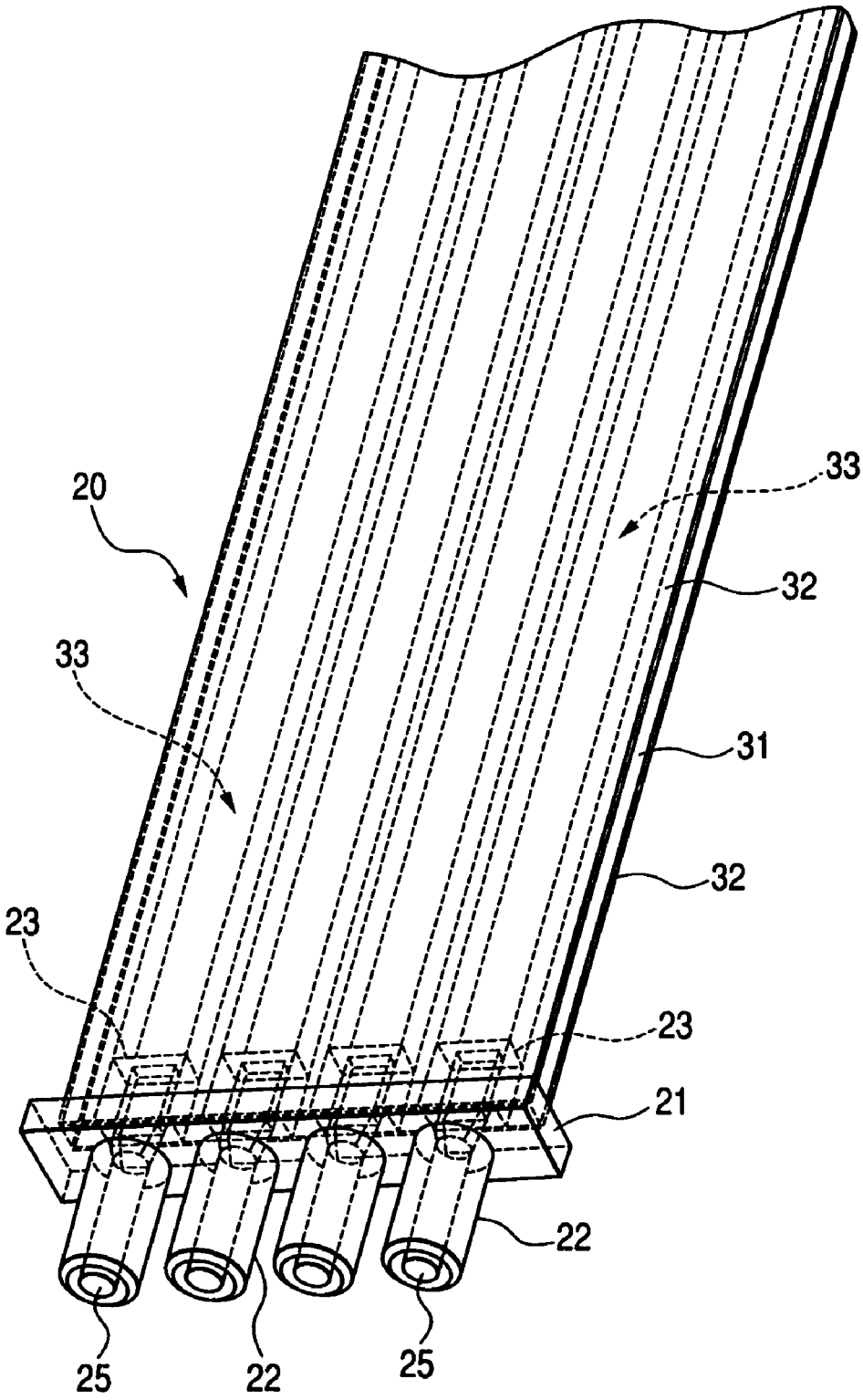
FIG. 7 is a perspective view of the liquid supplying member of FIG. 2.

FIG. 7 perspectively shows a state that the connection member 21 are fitted to the end of the ink supplying tube 20.

In the recording apparatus of the off-carriage type, with the reciprocal movement of the carriage 1, the ink in the ink supplying tube 20 receives an acceleration force. In this case, the acceleration force frequently causes the pressure fluctuation of ink in the recording head 8. To cope with this, generally a damper member is mounted on the carriage 1 to thereby absorb the fluctuation of the ink pressure.

However, in the ink supplying tube 20 described above, the ink supplying passages 33 are each surrounded by the elastic members 31 and the film members 32. With an elasticity of the film members 32 in particular, the damper function is secured. In this respect, the invention provides a recording device which is not provided with any special damper member by using the ink supplying tube 20.

Figure 8:
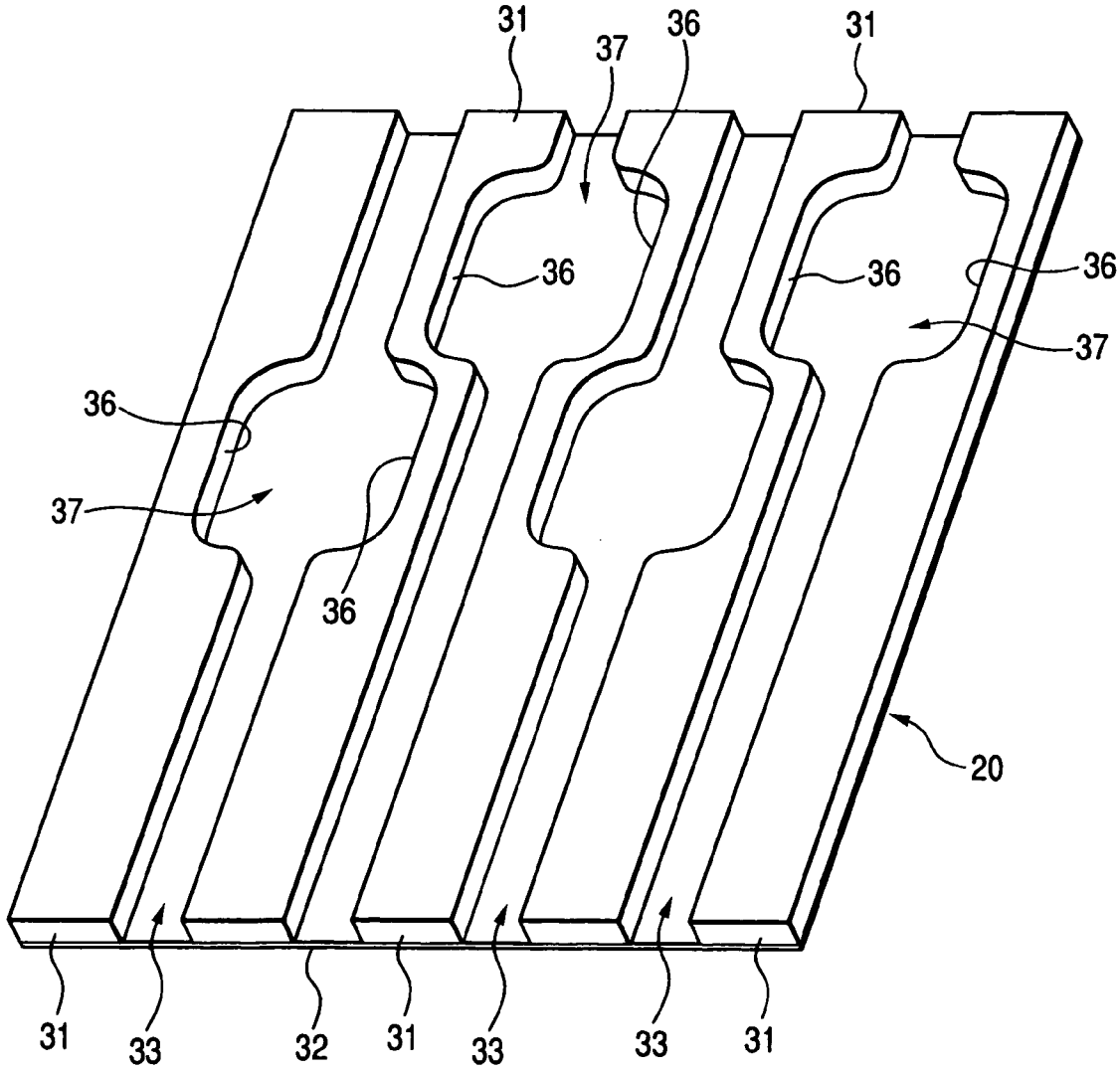
FIG. 8 is a disassembled perspective view of a modified example of the liquid supplying member of FIG. 2.

In a case where the damper function by the film members 32 is insufficient, recessed portions 36 may be formed at opposed positions of the elastic members 31 as shown in FIG. 8. As a result, a space between the opposed positions of the elastic members 31 is increased to form an enlarged space 37. Incidentally, FIG. 8 shows a state that the upper film member 32 is removed.

In the ink supplying tube thus constructed, broad areas resulting from presence of the enlarged spaces 37 are secured at portions of the ink supplying tube 20, whereby the damper function is effectively exhibited. The enlarged spaces 37 are preferably located at downstream positions of the ink supplying passages 33 of the ink supplying tube 20, that is, closer to the carriage 1.

Figure 9A:
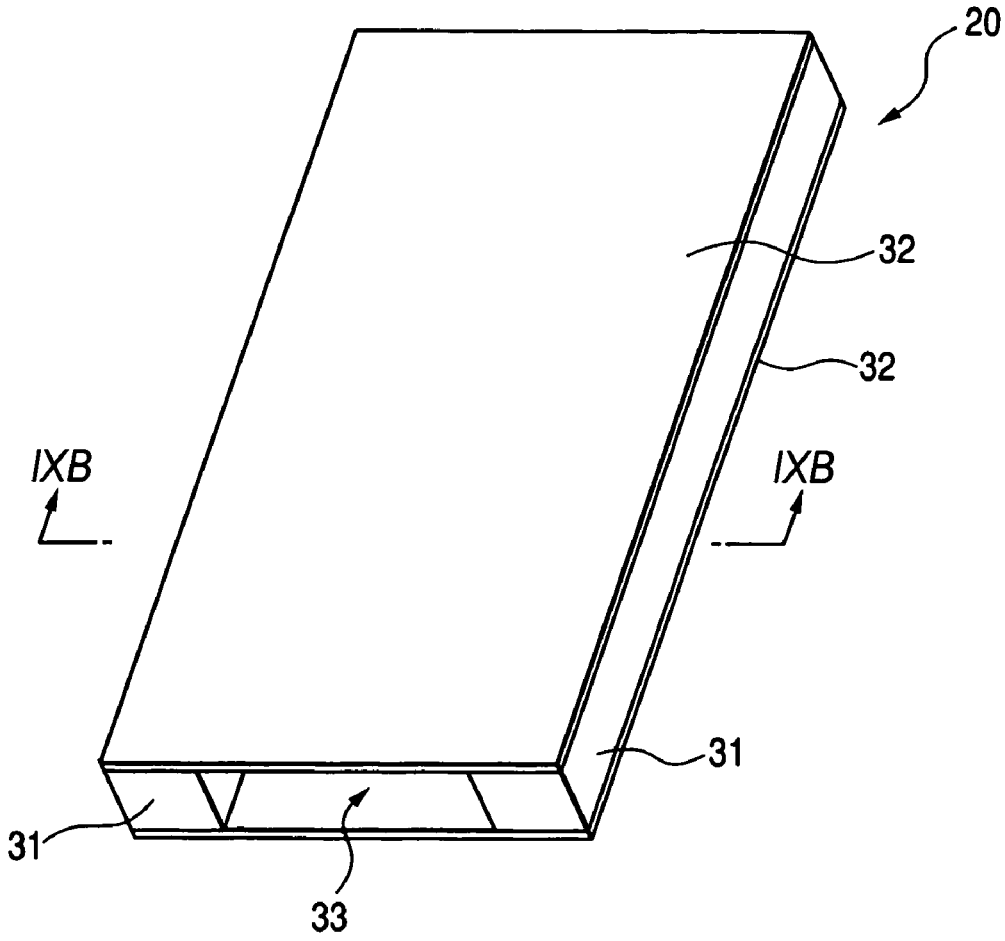
FIG. 9A is a partial perspective view of a liquid supplying member according to a second embodiment of the invention.
Figure 9B:
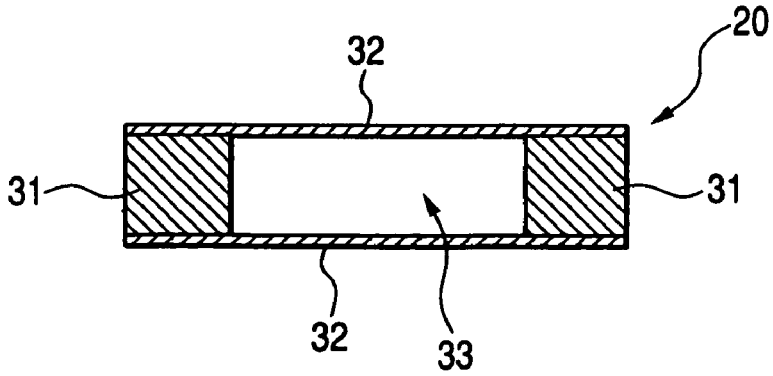
FIG. 9B is a section view taken along a line IXB-IXB in FIG. 9A.

FIGS. 9A and 9B show an ink supplying tube according to a second embodiment of the invention. The members as same as those explained in the first embodiment are designated by the same reference numerals, and repetitive explanations will be omitted.

In this embodiment, since a single ink supplying passage 33 is provided in a single ink supplying tube 20, four independent tubes are to be incorporated in the apparatus shown in FIG. 1.

Although it is not explicitly shown in these figures, it is preferable to form thin films 34 on the outer faces of the film member 32 by aluminum lamination process, as in the case shown in FIG. 6.

Figure 10A:
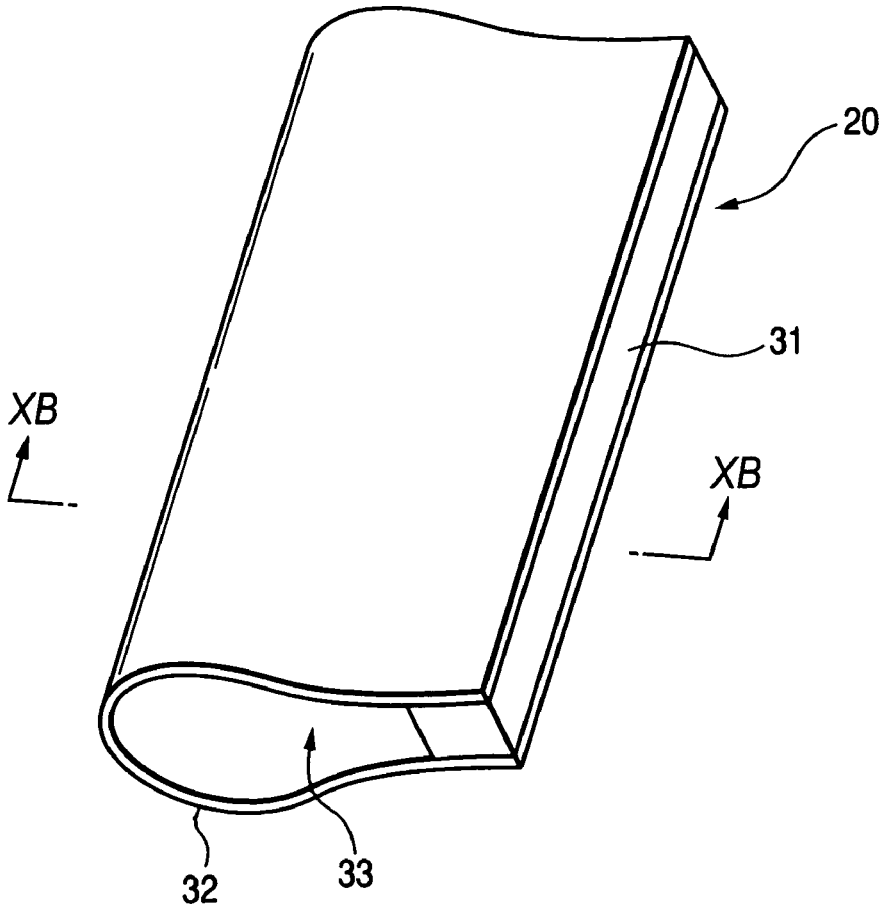
FIG. 10A is a partial perspective view of a liquid supplying member according to a third embodiment of the invention.
Figure 10B:
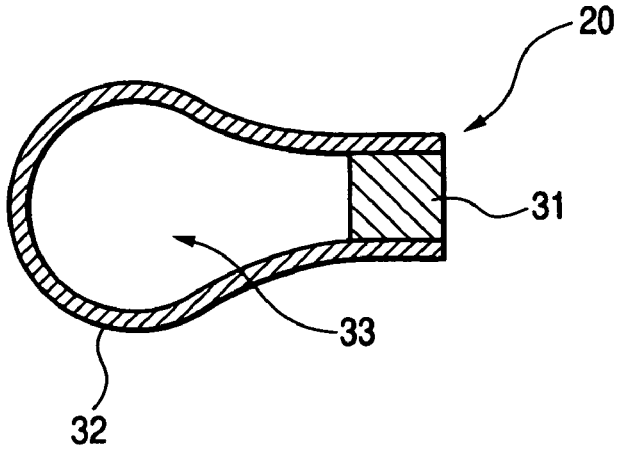
FIG. 10B is a section view taken along a line XB-XB in FIG. 10A.

FIGS. 10A and 10B show an ink supplying tube according to a third embodiment of the invention. The members as same as those explained in the first embodiment are designated by the same reference numerals, and repetitive explanations will be omitted.

In this embodiment, a single film member 32 is hermetically joined to the upper and lower faces of the elastic member 31 to define an ink supplying passage in an enclosing manner.

The film member 32 is joined to both sides of the elastic member 31 in a bag shape to thereby form an ink supplying passage 33. With such a structure, of a peripheral length of the inner surface of the ink supplying passage 33, a part defined by the film member 32 is longer than a part defined by the elastic member 31, i.e., a thickness of the elastic member 31.

As in the second embodiment, since a single ink supplying passage 33 is provided in a single ink supplying tube 20, four independent tubes are to be incorporated in the apparatus shown in FIG. 1.

Although it is not explicitly shown in these figures, it is preferable to form thin films 34 on the outer faces of the film member 32 by aluminum lamination process, as in the case shown in FIG. 6.

Figure 11:
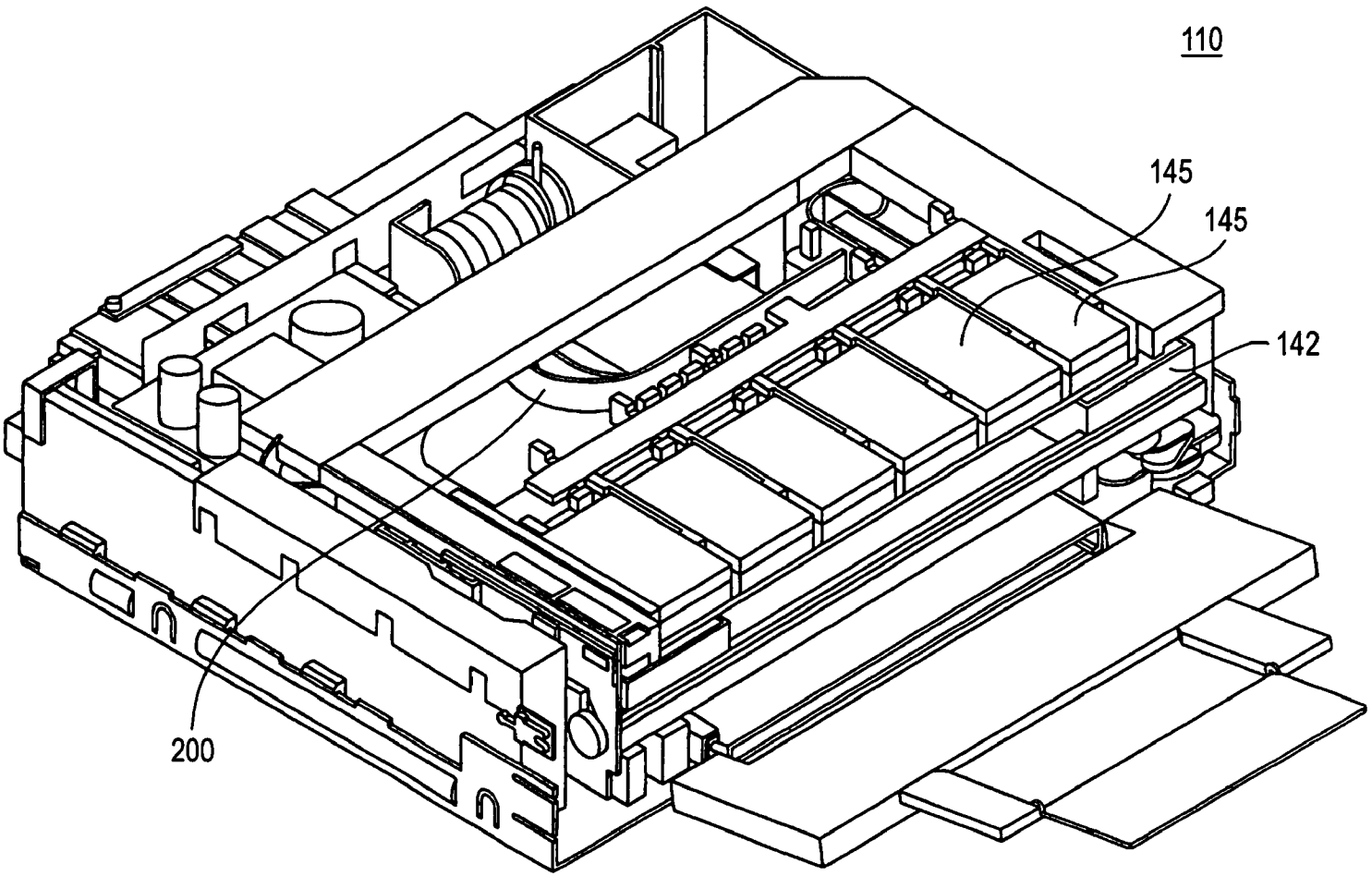
FIG. 11 is a perspective view of an ink jet recording apparatus.
Figure 12:
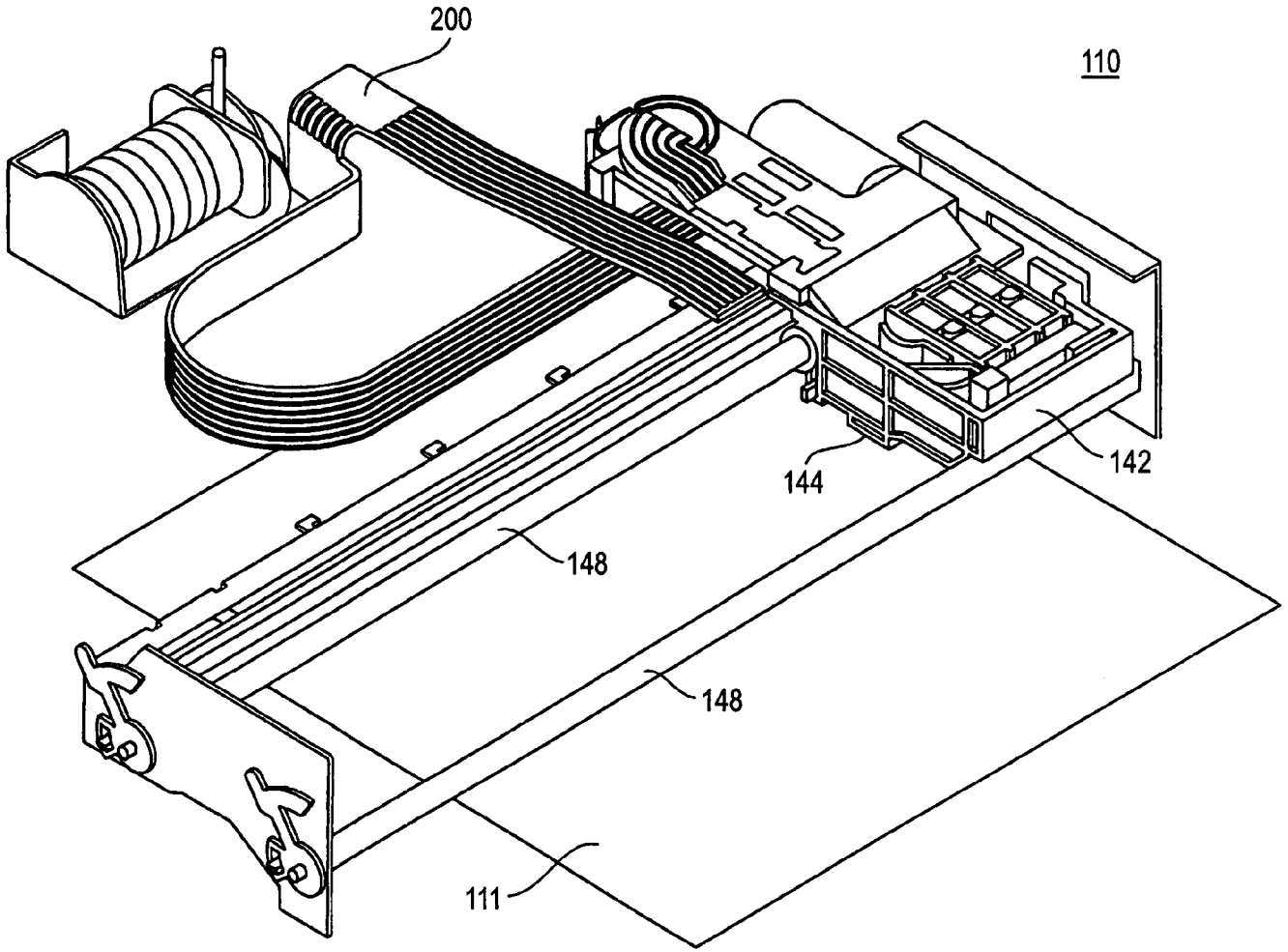
FIG. 12 is a perspective view of the ink jet recording apparatus in a disassembled state.

As shown in FIGS. 11 and 12, an ink jet recording apparatus 110 is provided with: a carriage 142 which reciprocally travels so as to straddle a recorded object; a recording head 144 which is mounted on the carriage 142 and subjects the object to recording, writing, or printing by ejecting a plurality of colors of ink to the object; a plurality of cartridges 145 which contains different colors of ink therein; and a liquid supplying member 200.

The carriage 142 is reciprocally moved along a guide shaft 148 by an unillustrated motor. The cartridges 145 are fixed not to the carriage 142 but to the main body of the ink jet recording apparatus 110. The liquid supplying member 200 is made of plastic material (e.g., thermoplastic elastomer) and formed with a required number of channels (a plurality of channels in the embodiment) to supply a plurality of colors of ink held in the respective cartridges 145 to the recording head 144 that travels back and forth. The recording head 144 ejects ink to the object 111 located below a travel path of the recording head 144, to thus perform recording, writing, or printing operation. The plurality of colors of ink held in the cartridges 145 are supplied to one end 200*a* (see FIG. 15) of the liquid supplying member 200 by way of unillustrated stationary channels.

With such a configuration, it is possible to supply a plurality of colors of ink held in the plurality of cartridges 145 to the recording head 144 by attaching only one liquid supplying member 200 to the ink jet recording apparatus 110. Consequently, the ink jet recording apparatus 110 can be made compact. Further, the efforts required to mount the liquid supplying member 200 become smaller.

Here, in a case where an elastomer primarily made of SEPS (polystyrene-polyethylene-polypropylene-polystyrene) polymer is used as an elastic material to be used for forming the liquid supplying member 200 is used, the liquid supplying member 200 becomes softer than the polyethylene tube. In this case, the liquid supplying member 200 can be folded largely, to thereby render the ink jet recording apparatus 110 particularly compact. Moreover, when the carriage 142 is driven, the load exerted on a motor which drives the carriage 142 becomes smaller.

The ink jet recording apparatus 110 is an example of the liquid ejection apparatus. Further, the recording head 144 of the ink jet recording apparatus is an example of a liquid ejection head of the liquid ejection apparatus, and the cartridges 145 are examples of a liquid container.

However, the invention is not limited to these examples. Another example of the liquid ejection apparatus corresponds to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

The object 111 is a substance to be subjected to recording, writing, or printing as a result of ejection of liquid. For instance, the object includes recording paper, a circuit board on which a circuit pattern such as electrodes of a display are printed, a CD-ROM on which a label is printed, and a preparation on which a DNA circuit is to be printed.

Figure 13:
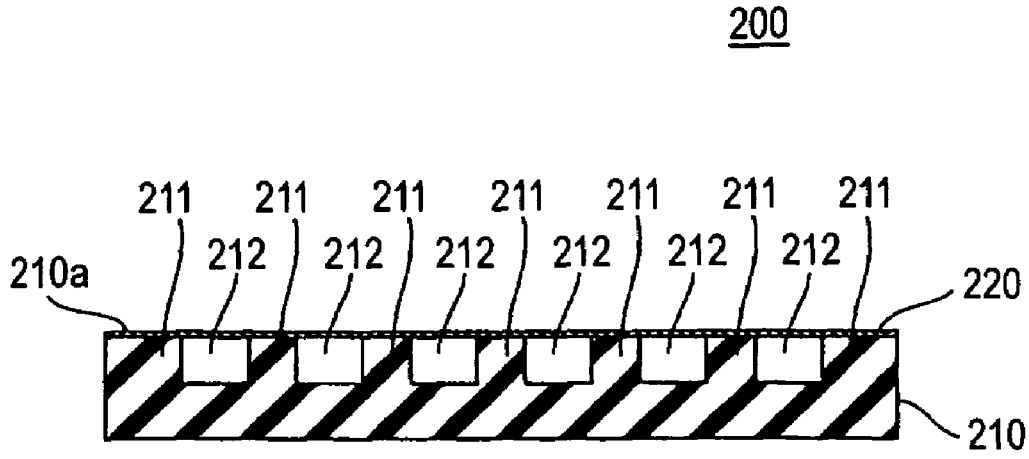
FIG. 13 is a section view of a liquid supplying member according to a fourth embodiment of the invention.

As shown in FIG. 13, the liquid supplying member 200 according to a fourth embodiment comprises a base member 210 made of plastic material, and an elongated plate member 220 joined to one face 210*a* of the base member 210 by, e.g., adhesion or welding. While being joined to the base member 210, the elongated plate member 220 has flexibility.

The base member 210 is formed with a plurality of elongated ridges 211 defining a plurality of individual grooves 212 each having rectangular cross section and arranged in a width direction of the base member 210. Open side of the grooves 212 are covered with the elongated plate member 112 to form a plurality of individual ink supplying passages.

Such a structure enables manufacture of the liquid supplying member 200 by injecting plastic material (e.g., a thermoplastic elastomer) into a mold, to thereby mold the base member 210. In this case, the base member 210 can be formed into a complicated geometry, and manufacturing costs can be reduced. In addition to the SEPS polymer, the plastic material constituting the liquid supplying member 200 preferably includes paraffin oil serving as a softening agent. Further, the plastic material may contain polypropylene along with or separately from the paraffin oil.

Among the ridges 211, ones provided at both widthwise ends of the base member 210 are wider than the remaining ridges 211. By such a configuration, the quantity of ink solvent (e.g., water) permeating through the base member 210 and the quantity of outside air which permeates through the base member 210 and dissolves in ink can be reduced.

Figure 14:
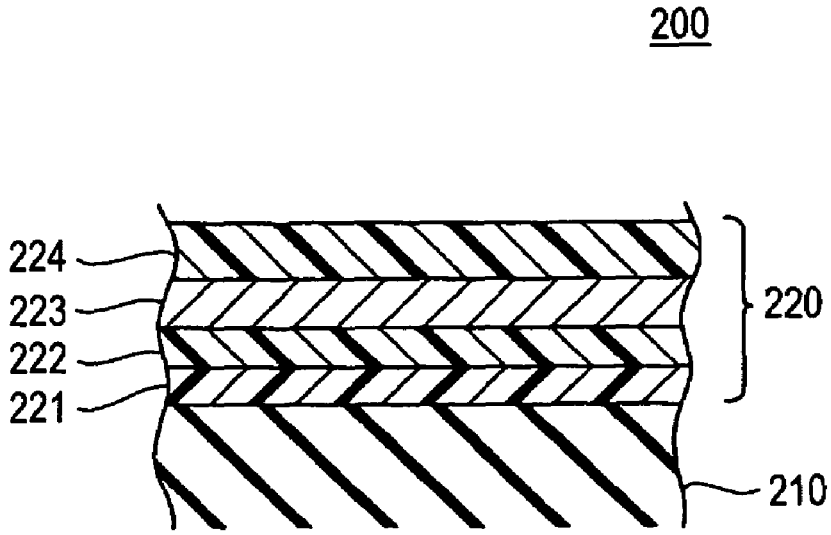
FIG. 14 is an enlarged section view of an elongated plate member of the liquid supplying member.

As shown in FIG. 14, the elongated plate member 220 has a multilayered structure in which a welding layer 221, a reinforcement layer 322, a metal layer 223, and a protective layer 224 are laminated, in the order given from the base member 210.

The welding layer 221 is for joining the elongated plate member 220 to the base member 210 by welding. In a case where the base member 210 includes the polypropylene as well as the SEPS, the welding layer 221 is formed from polyethylene or polypropylene.

The reinforcement layer 322 is for reinforcing the elongated plate member 220. The reinforcement layer 322 also serves to improve the heat resistance of the elongated plate member 220. Specifically, the reinforcement layer 322 is formed from polyamide.

The metal layer 223 is formed of an aluminum foil, for example. Providing the metal layer 223, the elongated plate member 220 serves to prevent evaporation of a solvent (water, for example) contained in ink. The metal layer 223 also serves to prevent exterior air from penetrating through the elongated plate member 220 and dissolving in the ink.

The protective layer 224 serves to protect the metal layer 223 physically and thermally, and is formed from, e.g., polyethylene terephthalate. The protective layer 224 also serves to reinforce the elongated plate member 220.

Figure 18:
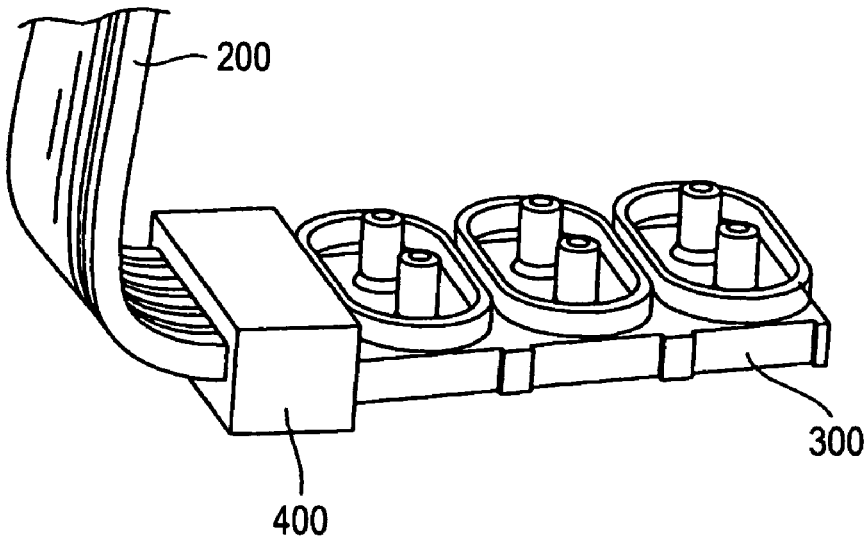
FIG. 18 is a perspective view of one side of a connector showing a state that the liquid supplying member is connected.

The liquid supplying member 200 can be flexed in a direction orthogonal to the face 210*a* of the base member 210 as shown in FIG. 18. Since the base member 210 has elasticity higher than that of the elongated plate member 220, it is preferable to bent the liquid supplying member 200 such that the base member 210 faces inwards. In this case, the elongated plate member 220 becomes less prone to being exfoliated from the base member 210. Further, the elongated plate member 220 becomes less susceptible to slitting.

Figure 15:
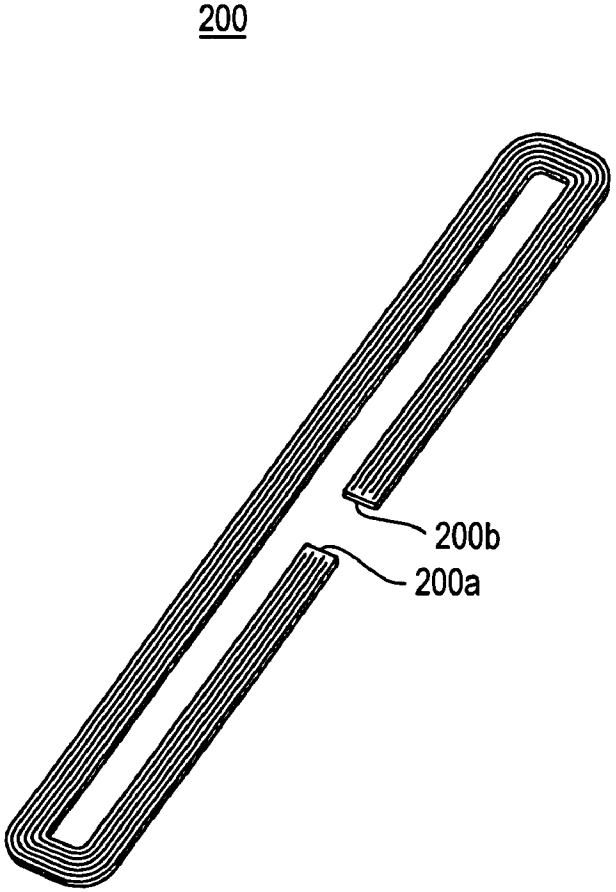
FIG. 15 is a perspective view of the liquid supplying member.

In a non-flexed state, as shown in FIG. 15, both ends 200*a* and 200*b* opposed to each other in the vicinity of the longitudinal center portion of the liquid supplying member 200. The liquid supplying member 200 is curved at an angle of 180° and at positions about a quarter of an entire longitudinal length from the both ends 200*a* and 200*b*.

With such a configuration, when the base member 210 is subjected to the injection molding, the plastic material having flown through a single channel can be caused to simultaneously inject into areas in the mold corresponding to the both ends 200*a*, 200*b*, and the center section of the base member 210. Accordingly, even when the liquid supplying member 200 is long, the base member 210 can be formed through injection molding.

Figure 16:
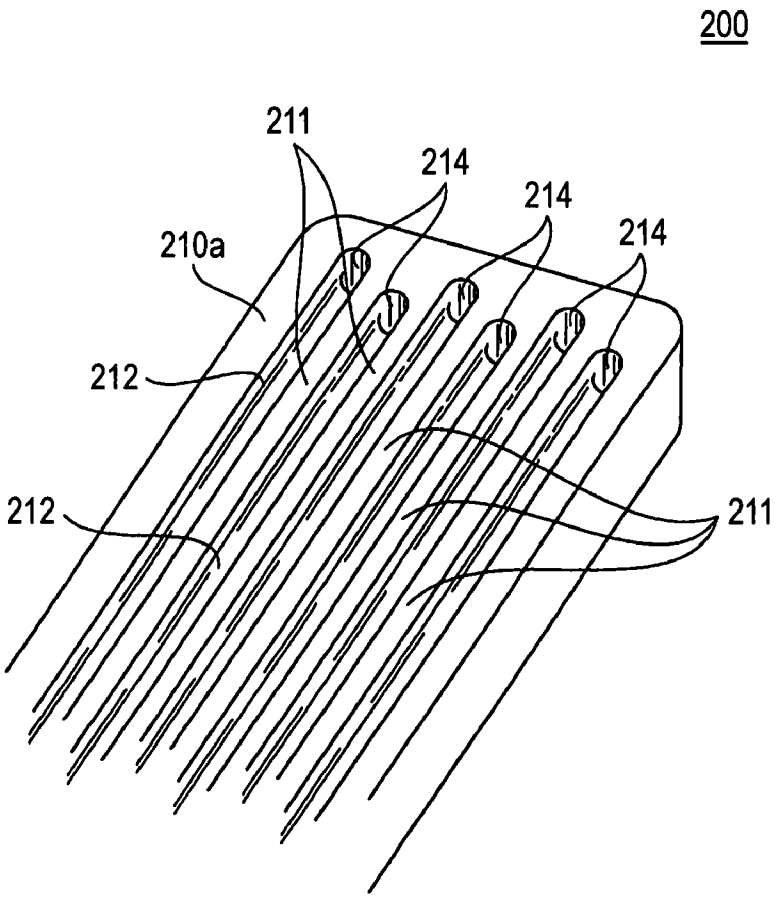
FIG. 16 is an enlarged perspective view showing one side of a base member of the liquid supplying member.

As shown in FIG. 16, each of the grooves 212 formed in the face 210*a* extends up to a position before one end 200*a* of the base member 210 and is connected to a through hole 214 penetrating through to the other side face 210*b* opposite the face 210*a*.

Figure 17:
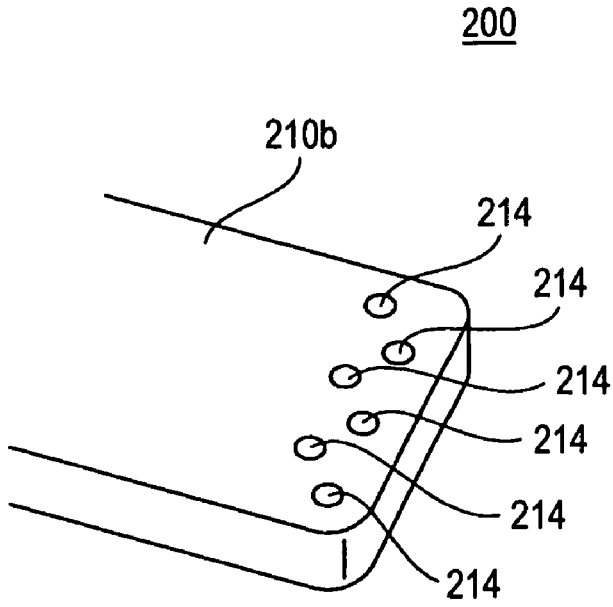
FIG. 17 is an enlarged perspective view showing the other side of a base member of the liquid supplying member.

As shown in FIG. 17, the through holes 214 are arranged so as to become staggered with respect to the longitudinal direction of the base member 210 so that the diameters of the through holes 214 can be made larger than those achieved in a case where the through holes 214 are arranged in parallel.

In the other end 210*b* of the liquid supplying member 200 is configured so as to be identical with the end 200*a*.

As shown in FIG. 18, the ink supplying member 200 is fastened to a connector 300 by a retainer 400. The connector 300 is a member for readily connecting the liquid supplying member 200 to the carriage 142 or the recording head 144. The connector 300 and the retainer 400 are formed from plastic material which is higher in rigidity than the liquid supplying member 200 at the room temperature.

Figure 19:
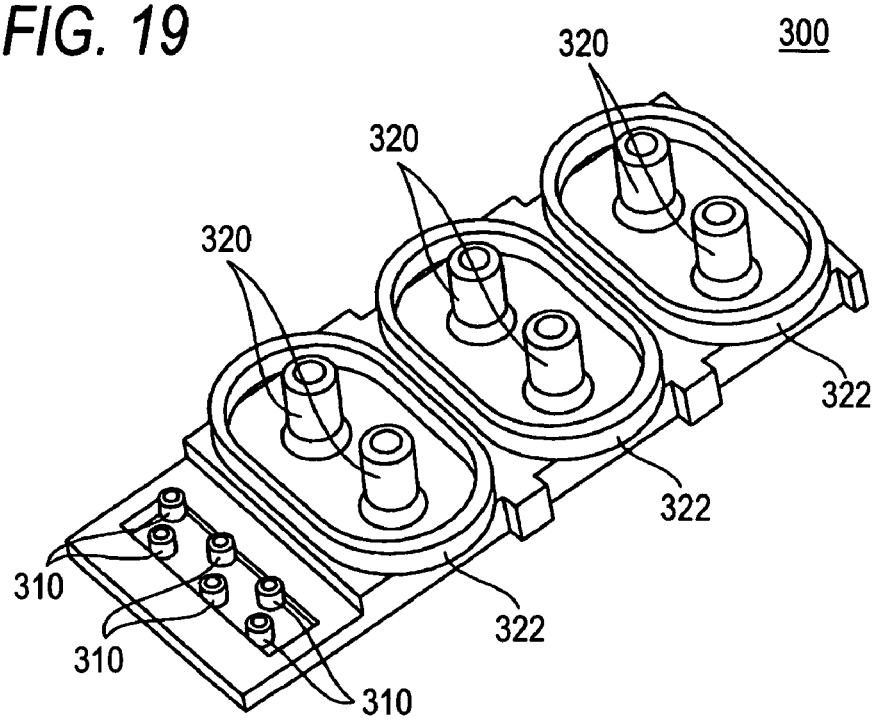
FIG. 19 is a perspective view of the connector showing a state that the liquid supplying member is disconnected.
Figure 20:
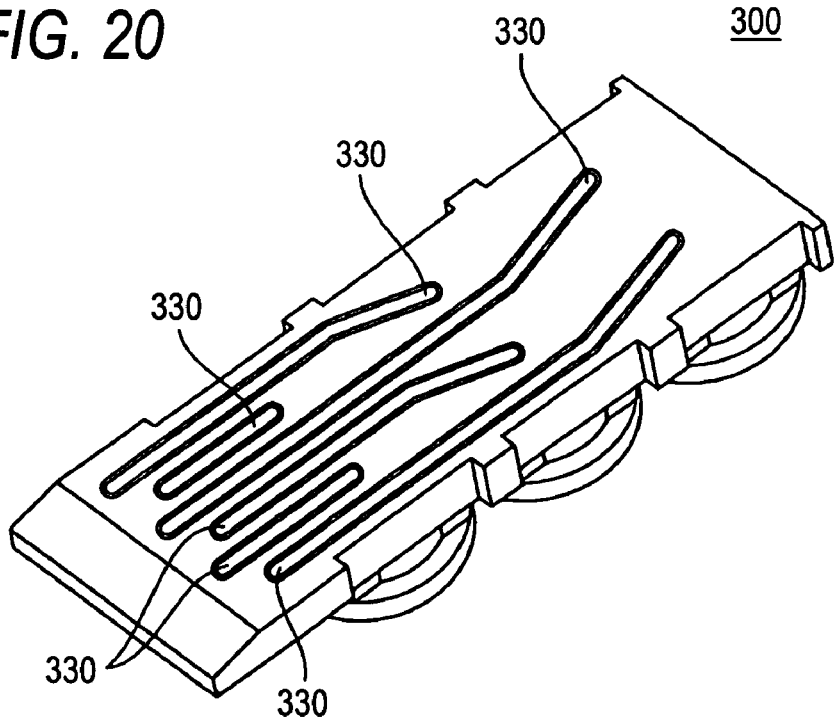
FIG. 20 is a perspective view of the other side of the connector.

As shown in FIGS. 19 and 20, the connector 300 is provided with: a plurality of cartridge-side connecting ports 310 respectively fitted with the through holes 214; a plurality of head-side connecting ports 320 respectively fitted with the carriage 142; and channels 330 respectively communicating the cartridge-side connecting ports 310 and the head-side connecting ports 320. The retainer 400 clamps the liquid supply member 200 in such a direction that the connecting ports 310 are forced to be inserted into the through holes 214.

The connecting ports 310 are tubular members provided so as to stand upright on the main body of the connector 300 and are arranged along one longitudinal end of the connector 300 in a staggered manner. The arrangement of the connecting ports 310 corresponds to the layout of the through holes 214.

The connecting ports 320 are tubular members standing upright on the main body of the connector 300. A predetermined number of the connecting ports 320 are provided at separated positions and are arranged in parallel with a short side of the connector 300, thereby constituting groups. In the embodiment, each group comprises a pair of connecting ports 320. Packings 322 are provided so as to surround the respective groups so that the chance of leakage of ink from the connection between the connecting ports 320 and the recording head 144 can be prevented. Here, the packings 322 may be omitted.

In the embodiment, the connecting ports 310 and 320 are provided on the same side of the main body of the connector 300. However, they may be provided on different sides of the main body.

Another preferred embodiments of the invention will be described below. Members substantially identical with those described in the fourth embodiment are designated by the same reference numerals, and detailed explanation for those will be omitted.

Figure 21:
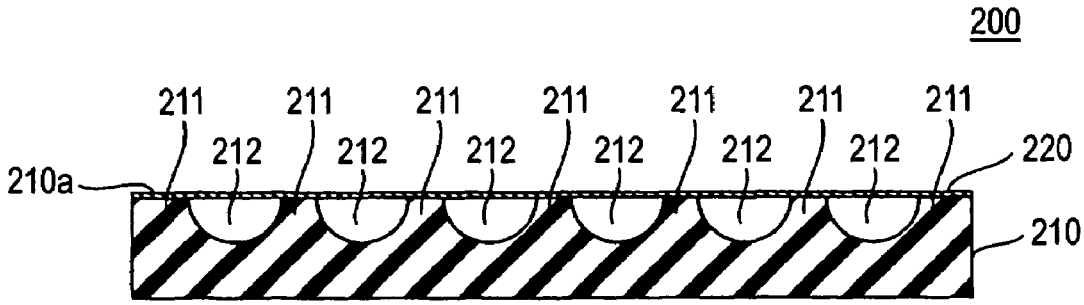
FIG. 21 is a section view of a liquid supplying member according to a fifth embodiment of the invention.

FIG. 21 shows a liquid supplying member according to a fifth embodiment of the invention. In this embodiment, each of grooves 212 is configured so as to have a semicircular cross section, so that more smooth ink flows can be realized.

Figure 22:
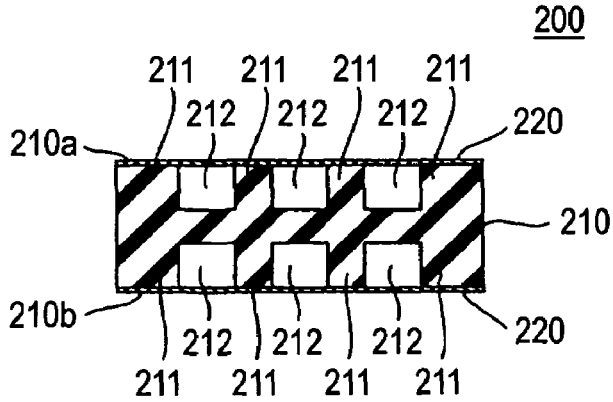
FIG. 22 is a section view of a liquid supplying member according to a sixth embodiment of the invention.

FIG. 22 shows a liquid supplying member according to a sixth embodiment of the invention. In this embodiment, ridges 211 and grooves 212 are provided in both of faces 210*a* and 210*b* of a base member 210. An elongated plate member 220 is joined to both the faces 210*a* and 210*b*. Accordingly, the number of grooves 212 per a unit area in the liquid supplying member 200 can be increased.

Figure 23:
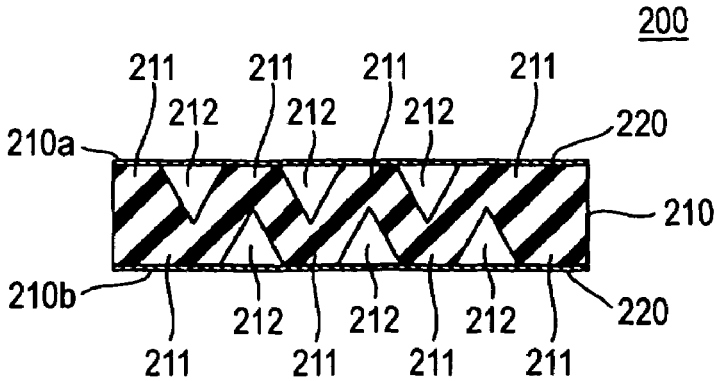
FIG. 23 is a section view of a liquid supplying member according to a seventh embodiment of the invention.

FIG. 23 shows a liquid supplying member according to a seventh embodiment of the invention. In this embodiment, each of grooves 212 has a triangular cross section. Ridges 111 and the grooves 212 are provided in both faces 210*a* and 210*b* of a base member 210. An elongated plate member 220 is caused to adhere to both the face 210*a* and 210*b*. The grooves 212 formed in the face 210*a* and the grooves 212 formed in the face 210*b* are arranged in a staggered manner with respect to the thickness direction of the base member 210. By such an arrangement, the number of the grooves 212 per a unit width in the liquid supplying member 200 can be increased, while the thickness of the liquid supplying member 200 can be reduced.

Figure 24:
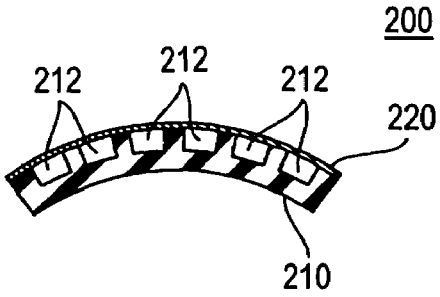
FIGS. 24 and 25 are section views of a liquid supplying member according to an eighth embodiment of the invention.
Figure 25:
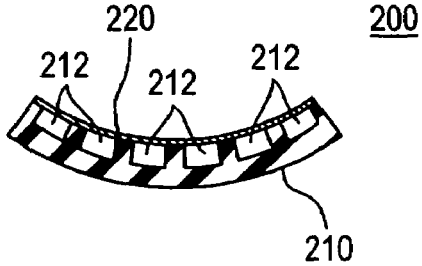
Figure 26:
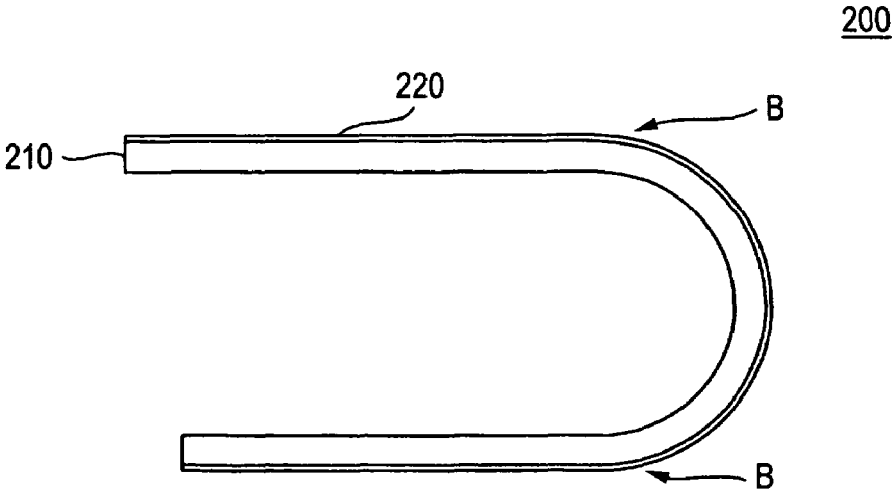
FIG. 26 is a side view showing the liquid supplying member of the eighth embodiment in a flexed state.

FIG. 24 shows a liquid supplying member according to a eighth embodiment of the invention. In this embodiment, at least a portion of a base member 210 to be flexed is curved such that a face in which grooves 212 are formed faces outward. It may be curved such that the face in which the grooves 212 are formed faces inward as shown in FIG. 25. With such a configuration, at portions B where the ink supplying member 200 is flexed shown in FIG. 26, the portions B can be flexed more compactly.

Figure 27:
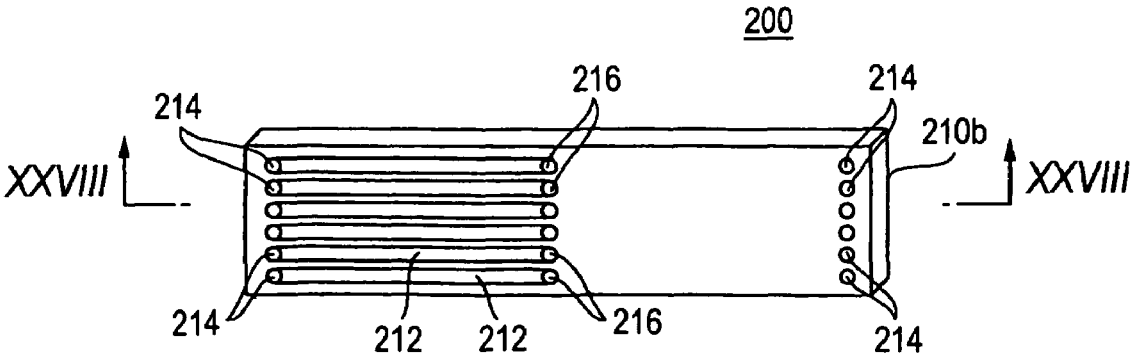
FIG. 27 is a perspective view of a liquid supplying member according to a ninth embodiment of the invention.
Figure 28:
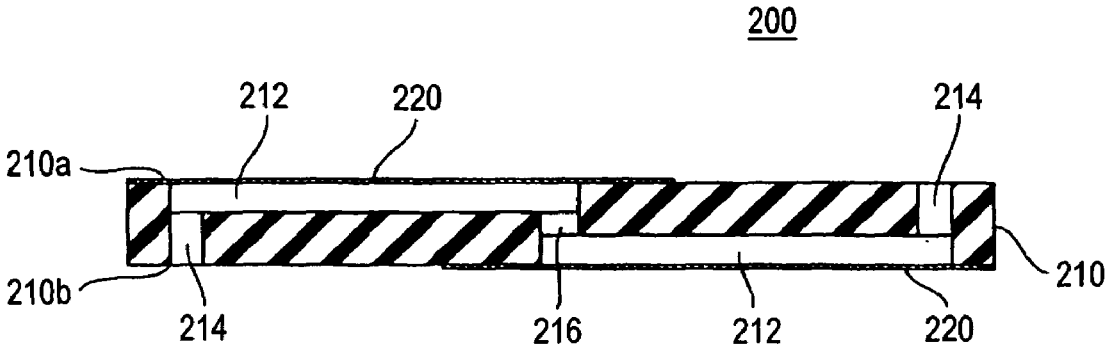
FIG. 28 is a section view taken along a line XXVIII-XXVIII in FIG. 27.

FIGS. 27 and 28 show a liquid supplying member according to a ninth embodiment of the invention. In this embodiment, ridges 211 and grooves 212 are provided in a face 210*a* of the liquid supplying member 200 within a range from one end 200*a* to an arbitrary intermediate point, while the ridges 211 and the grooves 212 are provided in an opposite face 210*b* within a range from the intermediate point to the other end 200*b*. Specifically, the ends of the grooves 212 provided in the face 210*a* and the ends of the grooves 212 provided in the face 210*b* are partly overlapped and communicated by connection channels 216.

With such a structure, the through holes 214 provided at the end 200*a* can be oriented in a direction different from that in which the through holes 214 formed at the other end 200*b* are oriented.

Figure 29:
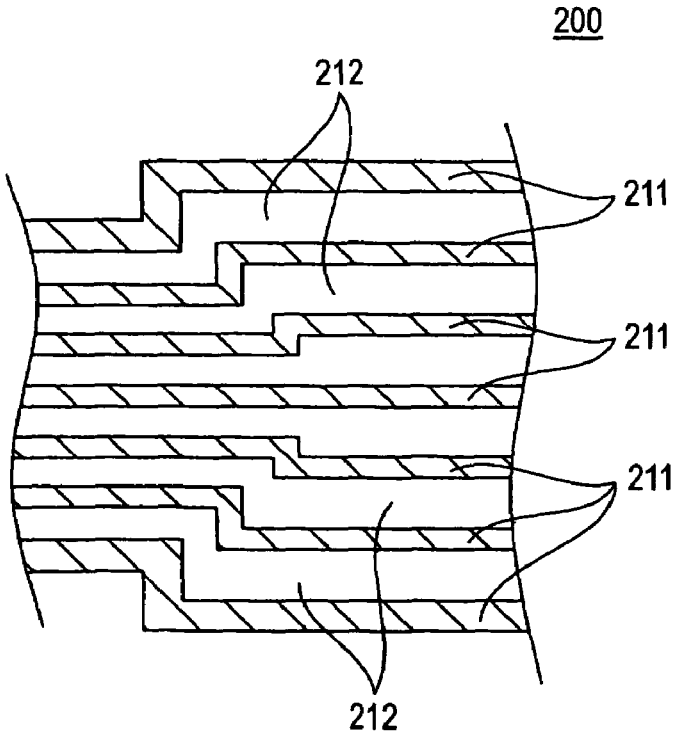
FIG. 29 is a transverse section view of a liquid supplying member according to a tenth embodiment of the invention.

FIG. 29 shows a liquid supplying member according to a tenth embodiment of the invention. In this embodiment, a cross-sectional area of each groove 212 changes at a certain intermediate point in the longitudinal direction of a base member 210. In order to change the cross-sectional area of the groove, the width of the groove 212 is changed at the intermediate point. However, the depth of the groove 212 may be changed at the intermediate point. A portion of the groove 212, which must be caused to pass through a narrow area in an ink jet recording apparatus 110, is given a small cross-sectional area, thereby making the cross section of the liquid supplying member 200 small. The other area of the groove 212 is given a wider cross-sectional area. In this case, a pressure loss in ink due to flow of ink through the groove 212 can be reduced.

Injection molding enables inexpensive manufacture of the base member 210 of such a structure.

Figure 30:
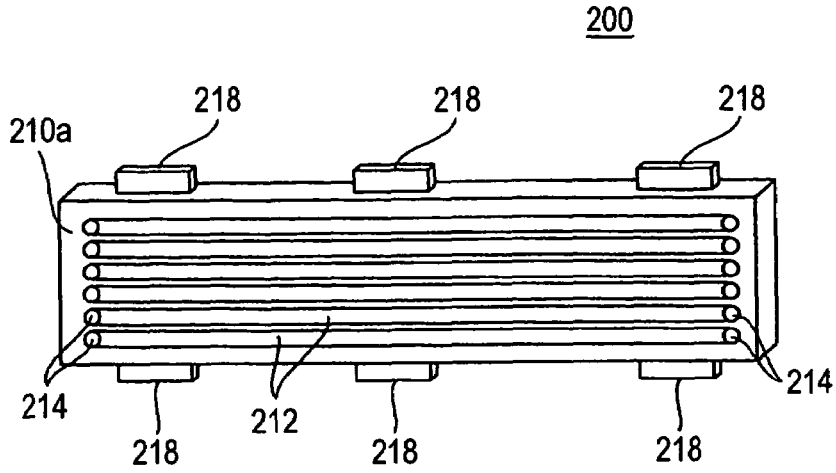
FIG. 30 is a perspective view of a liquid supplying member according to an eleventh embodiment of the invention.

FIG. 30 shows a liquid supplying member according to an eleventh embodiment of the invention. In this embodiment, a plurality of projections 218 for fixing purpose are provided on side faces of a base member 210. The projections 218 are for fixing the liquid supplying member 200 within an ink jet recording apparatus 110. Adopting the injection molding to form the base member 210, the positions and shape of the fixing projections 218 can be set arbitrarily in consideration of the shape and position of an area where the base member 210 is to be fixed.

Figure 31:
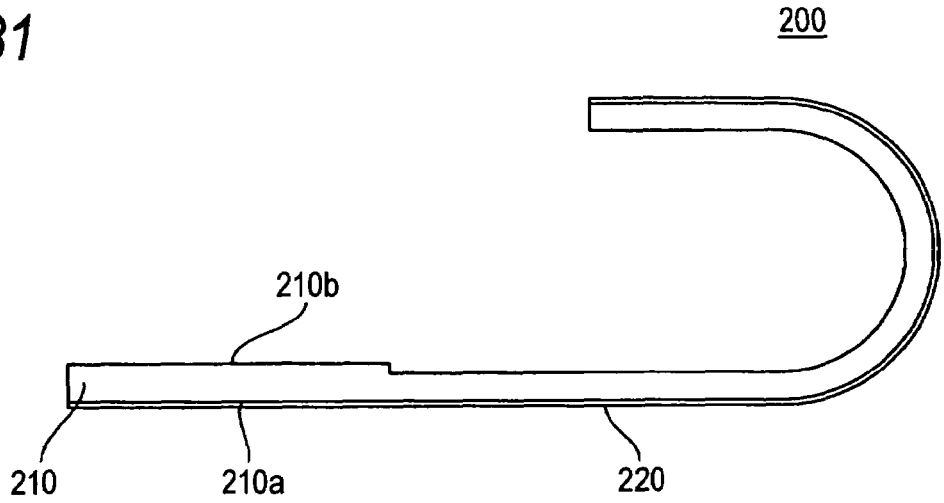
FIG. 31 is a side view of a liquid supplying member according to a twelfth embodiment of the invention.

FIG. 31 shows a liquid supplying member according to a twelfth embodiment of the invention. In this embodiment, a portion of a base member 210 which is not to be flexed is thicker than a portion of the base member 210 which is to be flexed.

With such a configuration, the solvent of ink becomes less prone to passing through the base member 210 and evaporating. Further, the liquid supplying member 200 remains easily foldable. In the modification, a face 210*a* in which grooves 212 are formed is made flush, and irregularities are formed in an opposite face 210*b*, thereby changing the thickness of the base member 210.

Figure 32:
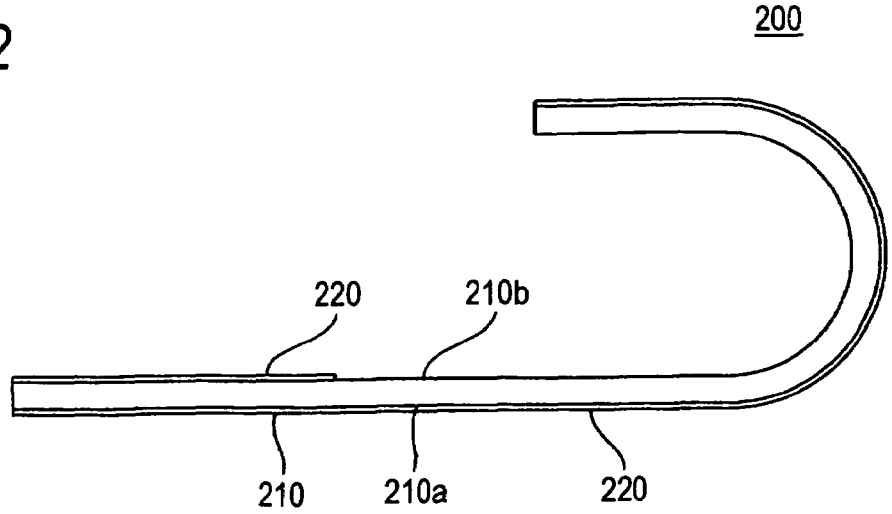
FIG. 32 is a side view of a liquid supplying member according to a thirteenth embodiment of the invention.

FIG. 32 shows a liquid supplying member according to a thirteenth embodiment of the invention. In this embodiment, each of a face 210*a* and a face 210*b* are provided with an elongated plate member 220 at a portion of a base member 210 which is not to be flexed, while only the face 210*a* is provided with the elongated plate member 220 at a portion of the base member 210 which is to be flexed.

With such a configuration, even if the solvent of ink has permeated through the base member 210, the solvent will be blocked by the elongated plate member 220, thereby rendering the ink less prone to evaporating. Since the elongated plate member 220 is joined to only the face 210*a* in the portion where the liquid supplying member 200 to be flexed, the flexibility of the liquid supplying member 200 is not impaired.

Figure 33:
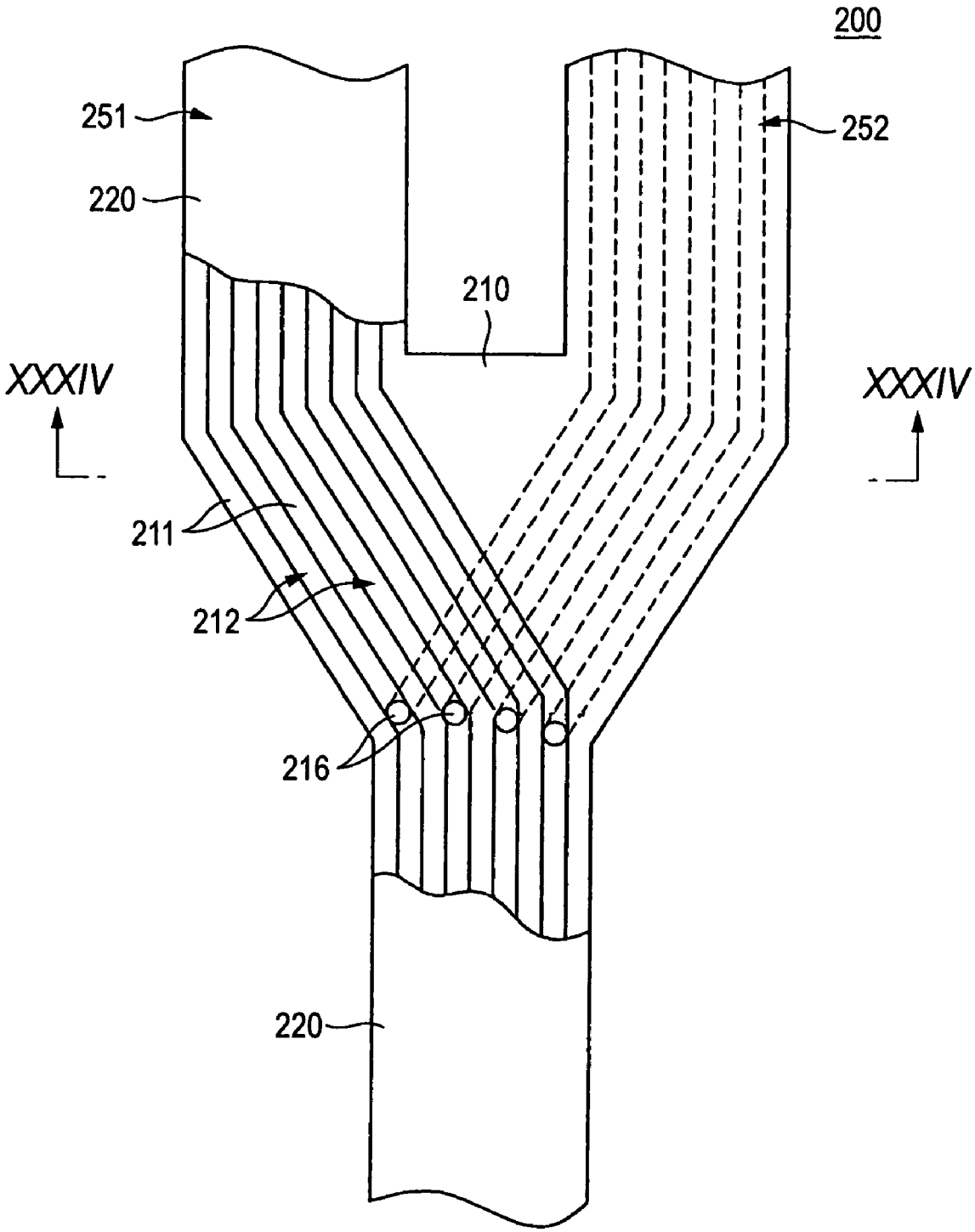
FIG. 33 is a plan view of a liquid supplying member according to a fourteenth embodiment of the invention.
Figure 34:
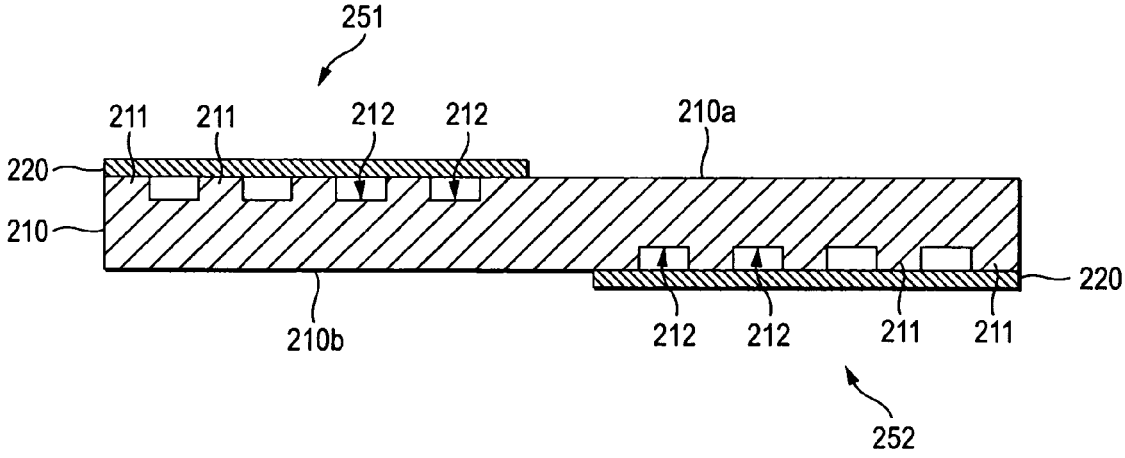
FIG. 34 is a section view taken along a line XXXIV-XXXIV in FIG. 33.

FIGS. 33 and 34 show a liquid supplying member 200 according to a fourteenth embodiment of the invention. In this embodiment, the head-side end of a base member 210 is branched so as to have branched portions 251, 252. In the branched portion 251, a plurality of grooves 212 are defined by ridges 211 formed on one side of the base member 210 and covered with an elongated plate member 220. In the branched portion 252, a plurality of grooves 212 are defined by ridges 211 formed on the other side of the base member 210 and covered with another elongated plate member 220. The grooves 212. The grooves 212 provided in the face 210*a* and the ends of the grooves 212 provided in the face 210*b* are partly overlapped and communicated by connection channels 216.

With this configuration, since a plurality colors of ink contained in the cartridges 145 can be supplied to two recording heads, it is not necessary to provide a plurality of liquid supplying members with respect to a plurality of recording heads in one-by-one manner.

To the contrary, the branched ends may be connected to the cartridges 145. In this case, ink can be supplied from a plurality of cartridges containing the same kind of ink to a common recording head, thereby lowering the probability that ink runs out during the recording operation.

Figure 35:
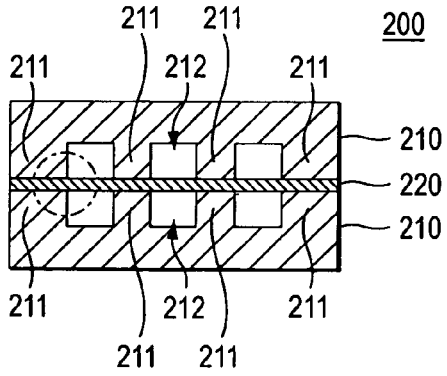
FIG. 35 is a section view of a liquid supplying member according to a fifteenth embodiment of the invention.

FIG. 35 shows a liquid supplying member 200 according to a fifteenth embodiment of the invention. In this embodiment, a pair of base members 210 having the same configuration that a plurality of grooves 212 are defined by a plurality of ridges 211 are inversely opposed and joined to an elongated plate member 220. Each of the base members 210 is joined to the elongated plate member 220 by welding, bonding with adhesive, for example, such that the elongated plate member 220 is sandwiched by the pair of base members 210, thereby forming a plurality of liquid supplying passages.

With this configuration, since the plural liquid supply passages can be arranged in the thickness direction of the liquid supplying member 200 in the multi-stage manner, the widthwise dimension of the liquid supplying member can be reduced in comparison with the case that the plural liquid supplying passages are arranged in the single-stage manner.

Moreover, since the pair of the base members 210 have the same configuration, the elongated plate member 220 is placed in the center position in the thickness direction of the liquid supplying member 200. The stretching or shrinking amount of the elongated plate member 220 in accordance with the fixing or bending of the liquid supplying member 200 due to the reciprocation of the carriage 142 becomes relatively small, in comparison with the case that the elongated plate member 220 is exposed. Accordingly, the elongated plate member 220 is hardly peeled from the base members 210.

Figure 36:
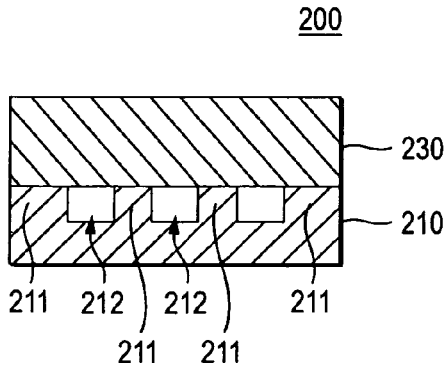
FIG. 36 is a section view of a modified example of the liquid supplying member of FIG. 35.

FIG. 36 shows a modified example of the liquid supplying member of FIG. 35. In this example a cover member 230 is provided in place of the upper base member 210 and the elongated plate member 220 in FIG. 35. The difference between the base member 210 the cover member 230 is only the existence or absence of the grooves 212. Since the thickness of the base member 210 and that the cover member 230 are identical, the joining surface therebetween is placed in the center position in the thickness direction of the liquid supplying member 200. As the same reason explained the above, the base member 210 and the cover member 230 are hardly peeled from each other. In a case where the elongated plate member 220 is interposed between the base member 210 and the cover member 230, it is possible to reduce both of the amount of ink solvent evaporating to the exterior through the cover member 230 and the amount of external air invading to the interior through the cover member 230.

Figure 37:
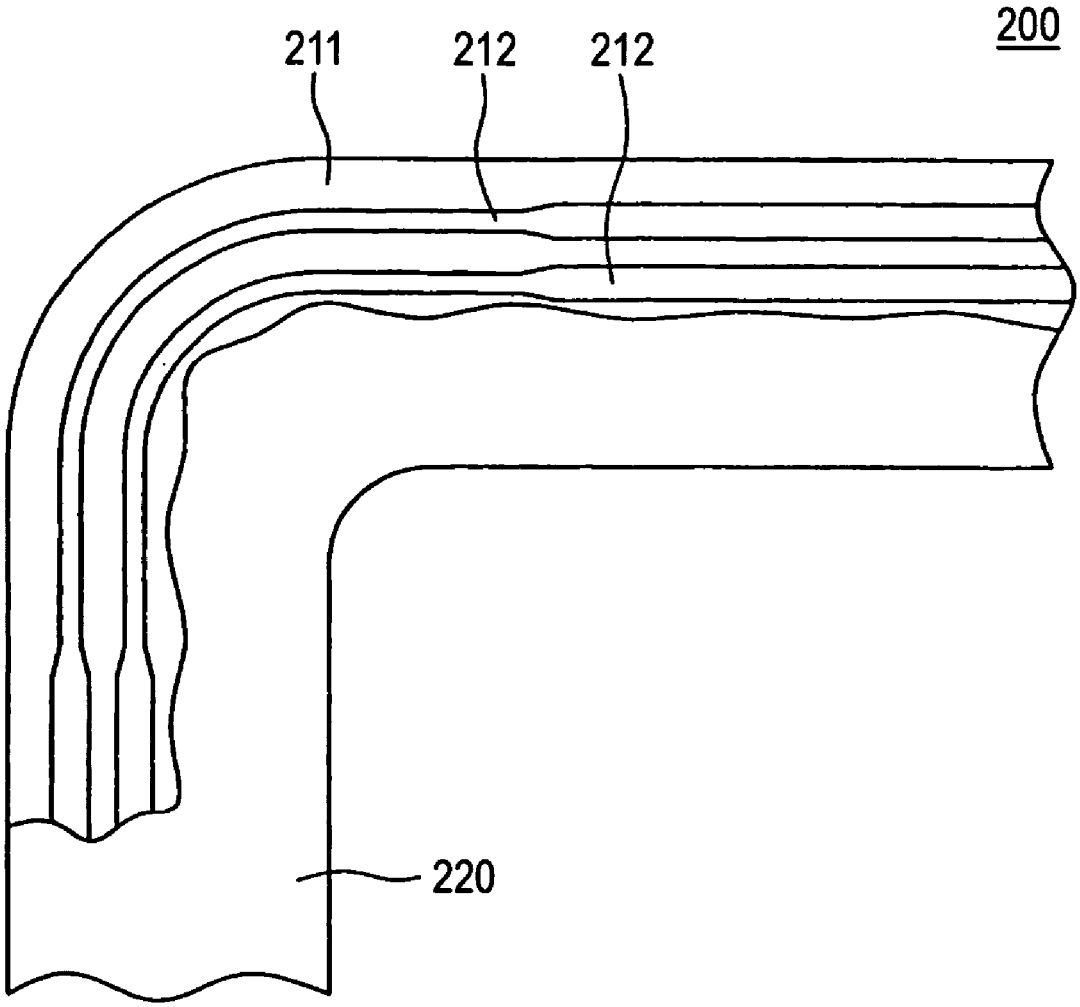
FIG. 37 is a section view of a liquid supplying member according to a sixteenth embodiment of the invention.

FIG. 37 shows a liquid supplying member 200 according to a sixteenth embodiment of the invention. In this embodiment, the cross sectional area of each of grooves 212 is reduced at a curved portion of the liquid supplying member 200. Specifically, the width of each of ridges 211 defining the grooves 212 is gradually enlarged toward the curved portion, so that the width of each groove 212 defined between a pair of ridges 211 is gradually reduced. With this configuration, the velocity of ink flowing in liquid supplying passages defined by the grooves 212 and an elongated plate member 220 increases toward the curved portion. Accordingly, air bubbles contained in the liquid supply passages hardly stay at the curved portion.

Figure 38:
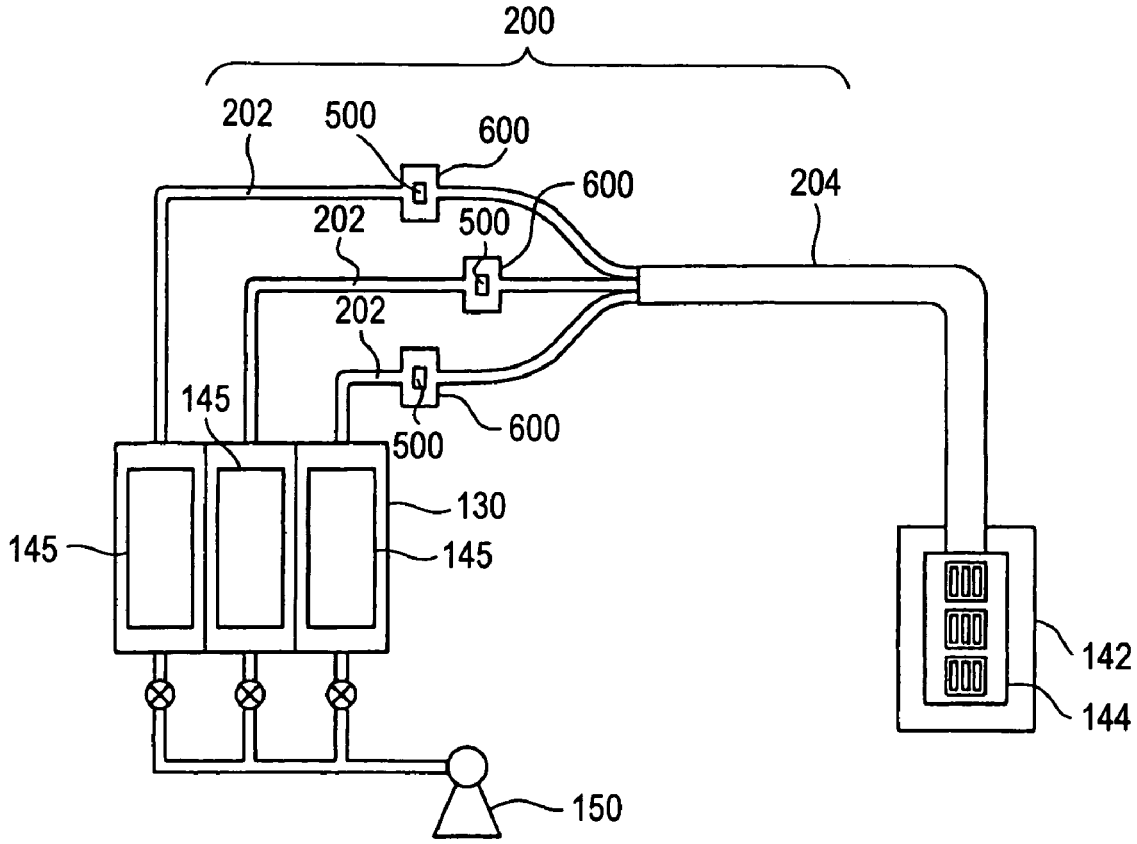
FIG. 38 is a schematic plan view of a liquid supplying member according to a seventeenth embodiment of the invention.
Figure 39:
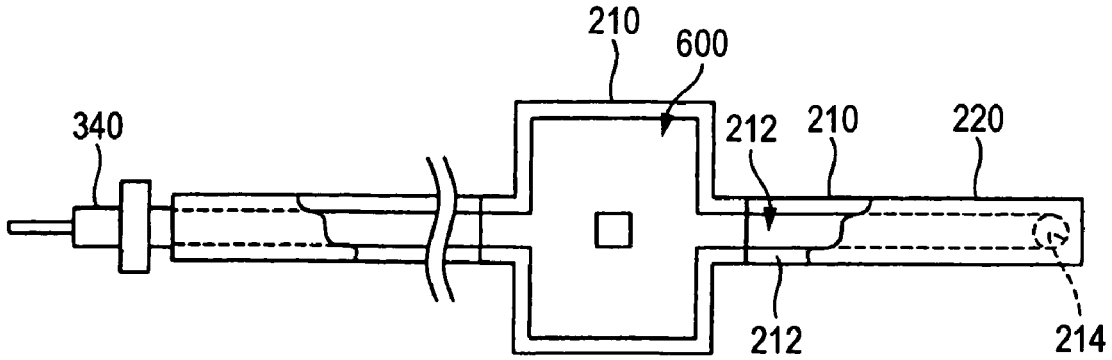
FIG. 39 is an enlarged plan view showing an essential part of the liquid supplying member of FIG. 38.

FIGS. 38 and 39 show a liquid supplying device incorporating a liquid supplying member 200 according to a seventeenth embodiment of the invention. In this embodiment, the liquid supplying member 200 is provided with a plurality of reservoirs 600 each of which temporarily stores one kind of ink supplied from one of a plurality of ink containers 145 for containing a plurality kinds of ink. According to the provision of the reservoirs 600, the flow resistance for ink is lowered, so that ink is smoothly supplied to the recording head 144 even when the amount of ink consumed by the recording head 144 is large. Moreover, the ink is smoothly supplied to the recording head 144 even when the ink containers 145 are disposed below the recording head 144.

Since the reservoirs 600 are monolithically formed with a base member 210 as shown in FIG. 39, the assembling cost can be reduced and the workability for mounting the liquid supplying member 200 can be enhanced.

In this embodiment, the liquid supplying member 200 includes a fixed passage section 202 and a flexible passage section 204. As shown in FIG. 39, the fixed passage section 202 is provided with connectors 340 to be connected to the ink containers 145, and connection holes 214 to be communicated with the flexible passage section 204. Specifically, each of the connectors 340 is monolithically molded with the base member 210, and hollowed so as to communicate with the reservoir 600. Each of the connection holes 214 is formed at the bottom of a groove 212 defined by ridges 211 so as to penetrate the base member 210.

As shown in FIG. 38, the ink supplying device comprises: a pump 150; container chambers 130 respectively accommodating the ink container 145 therein; and detectors 500 each of which is disposed in one of the reservoirs 600 for detecting the amount of ink remaining in the reservoir 600.

When the detector 500 detects that the remaining amount of ink is a reference value or less, the pump 150 is activated to compress the container chamber 130 associated with the reservoir 600 of interest to replenish ink from the liquid container 145 to the reservoir 600. Since the container chamber 130 is partitioned such that each of the partitioned spaces accommodates one of the ink containers 145, and a valve is provided for each of the partitioned spaces, each of the ink containers 145 can be independently compressed by the single pump 150 so that ink is supplied to only a reservoir 600 in which the amount of ink remaining therein is the reference value or less.

Alternatively, electromagnetic check valves may be provided at portions connecting the liquid supplying member 200 and the ink containers 145, so that ink is supplied to only a reservoir 600 in which the amount of ink remaining therein is the reference value or less by the opening/closing operation of the check valves.

Figure 40:
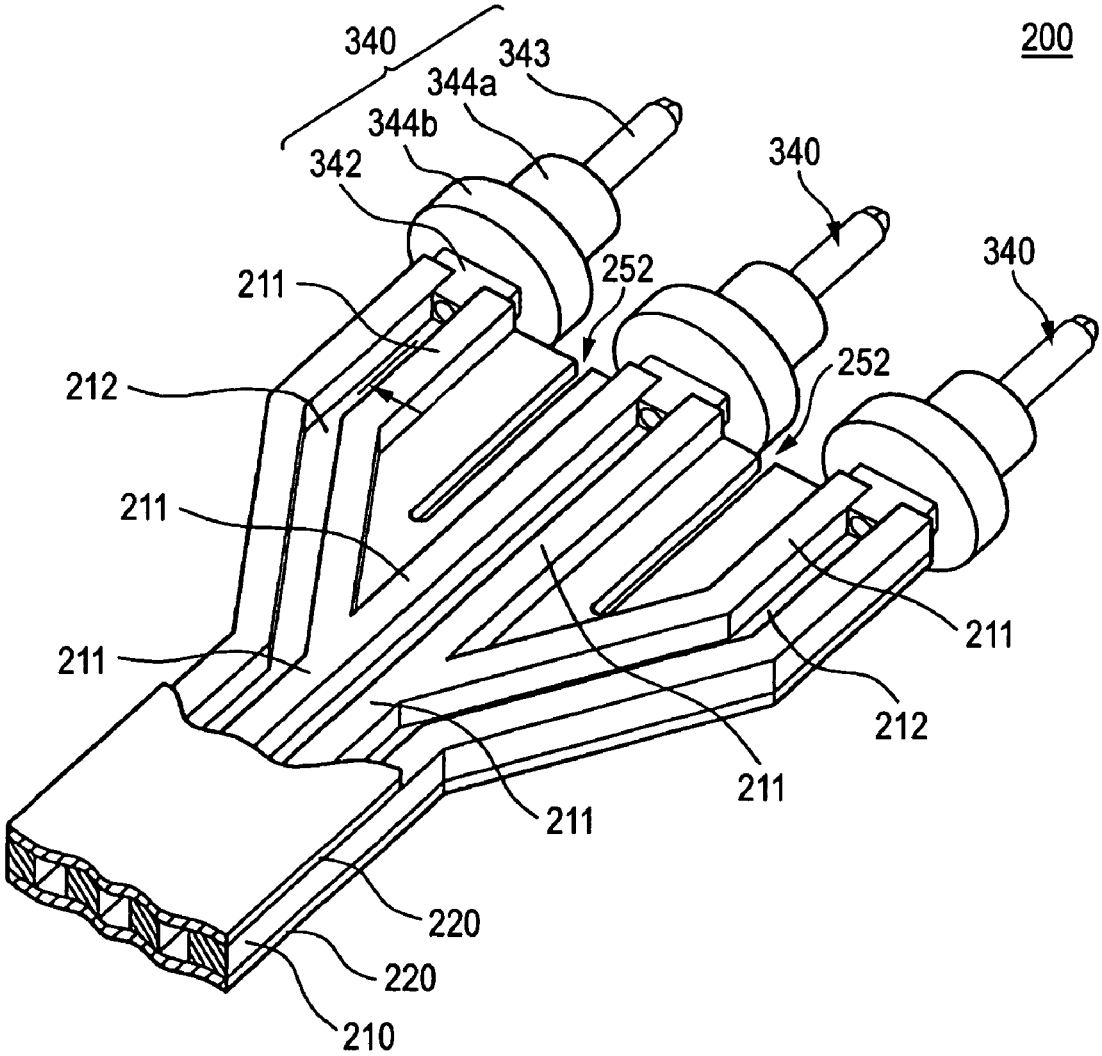
FIG. 40 is a perspective view of a liquid supplying member according to an eighteenth embodiment of the invention.

FIG. 40 shows a liquid supplying member 200 according to an eighteenth embodiment of the invention. In this embodiment, the width of a base member 210 at the end of the liquid supplying member 200 to be connected to the ink cartridges 145 is enlarged, and ridges 211 defining grooves 212 therebetween are branched at the enlarged part of the base member 210. Elongated plate member 220 is joined to the top faces of the ridges to form liquid supplying passages. At the enlarged part of the base member 210, branched passages are accordingly provided.

A slit 252 is formed between adjacent ones of the branched passages. Since each of the branched passages is freely moved, it is possible to alleviate the restriction or limitation for the arrangement of cartridge-side connectors and the accuracy of the positions of the respective connectors 340. The slits 252 may be formed before or after the elongated plate member 220 is joined onto the ridges 211.

Each of the branched passages is provided with a connector 340 to be connected to the ink cartridge 145. Since the connector 340 is monolithically molded with the base member 210, it is not necessary to provide the connector 340 separately and to attach the same to the base member 210.

It is preferable that the connector 340 is made of resin which is the same family as an elastomer for forming the base member 210. For example, in a case where the elastomer is comprised of polypropylene, the resin is preferable comprised of polypropylene-family resin. It is further preferable that the resin is so selected as to have a stiffness greater than the base member 210. In this case, the inserting operation of the connector 340 to the ink cartridge 145 can be facilitated.

More specifically, each of the connectors 340 comprises: a coupling member 342 coupled with the ridges 211 and the elongated plate member 220; a needle member 343 to be inserted to the ink cartridge 145; and cylindrical members 344*a*, 344*b* connecting the coupling member 342 and the needle member 343. The diameter of the cylindrical member 344*a* is larger than that of the needle member 343, and is smaller than that of the cylindrical member 344*b*. The diameter of the needle member 343 is so determined as to be smaller than the inner width of the liquid supplying passage defined by the ridges 211 and the elongated plate member 220. This facilitates the insertion of the needle member 343 to the ink cartridge 145.

With this configuration, since a plurality colors of ink contained in the cartridges 145 can be supplied to plural recording heads, it is not necessary to provide a plurality of liquid supplying members with respect to a plurality of recording heads in one-by-one manner.

Figure 41:
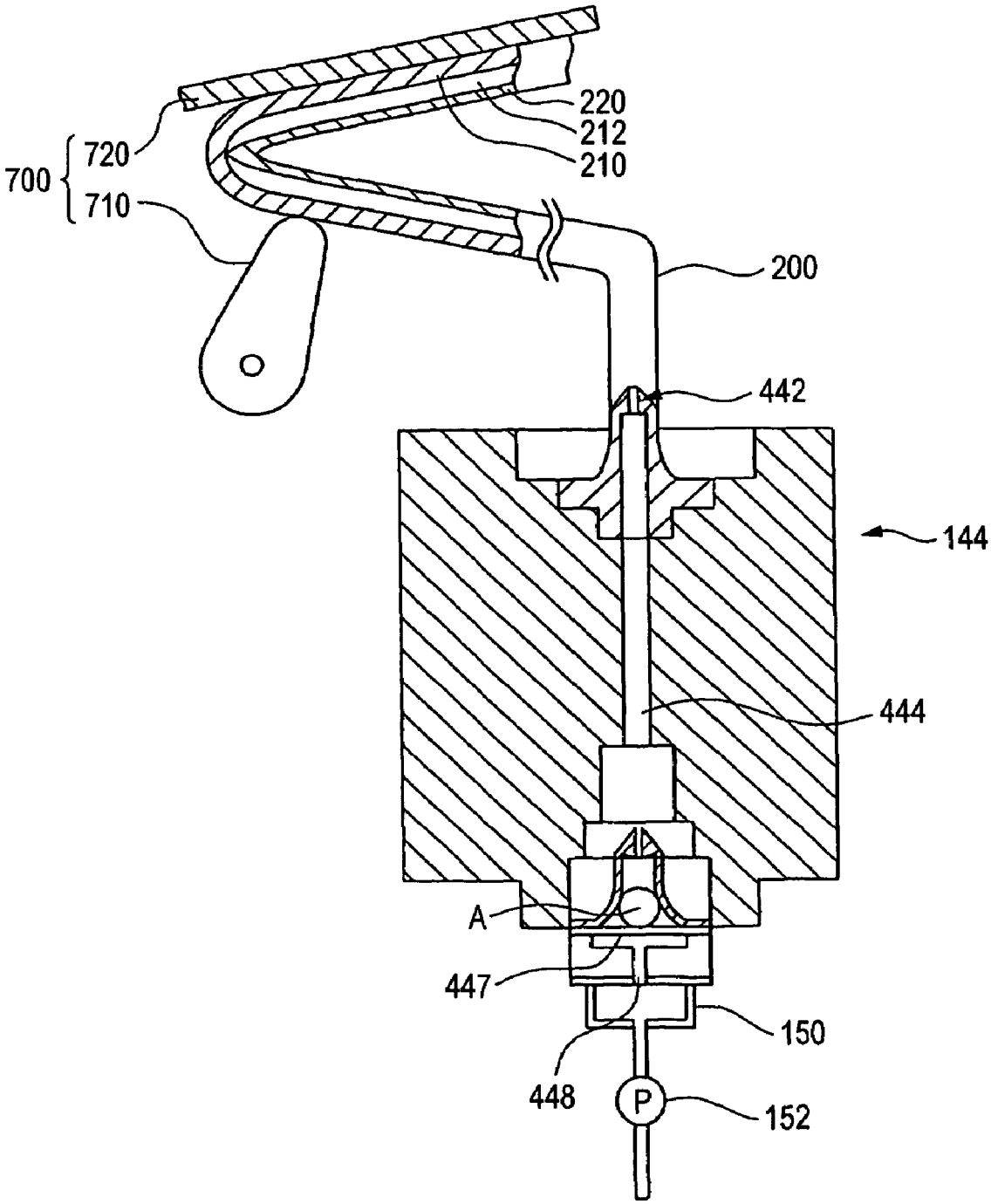
FIGS. 41 and 42 are schematic section views of a liquid supplying member according to a nineteenth embodiment of the invention.
Figure 42:
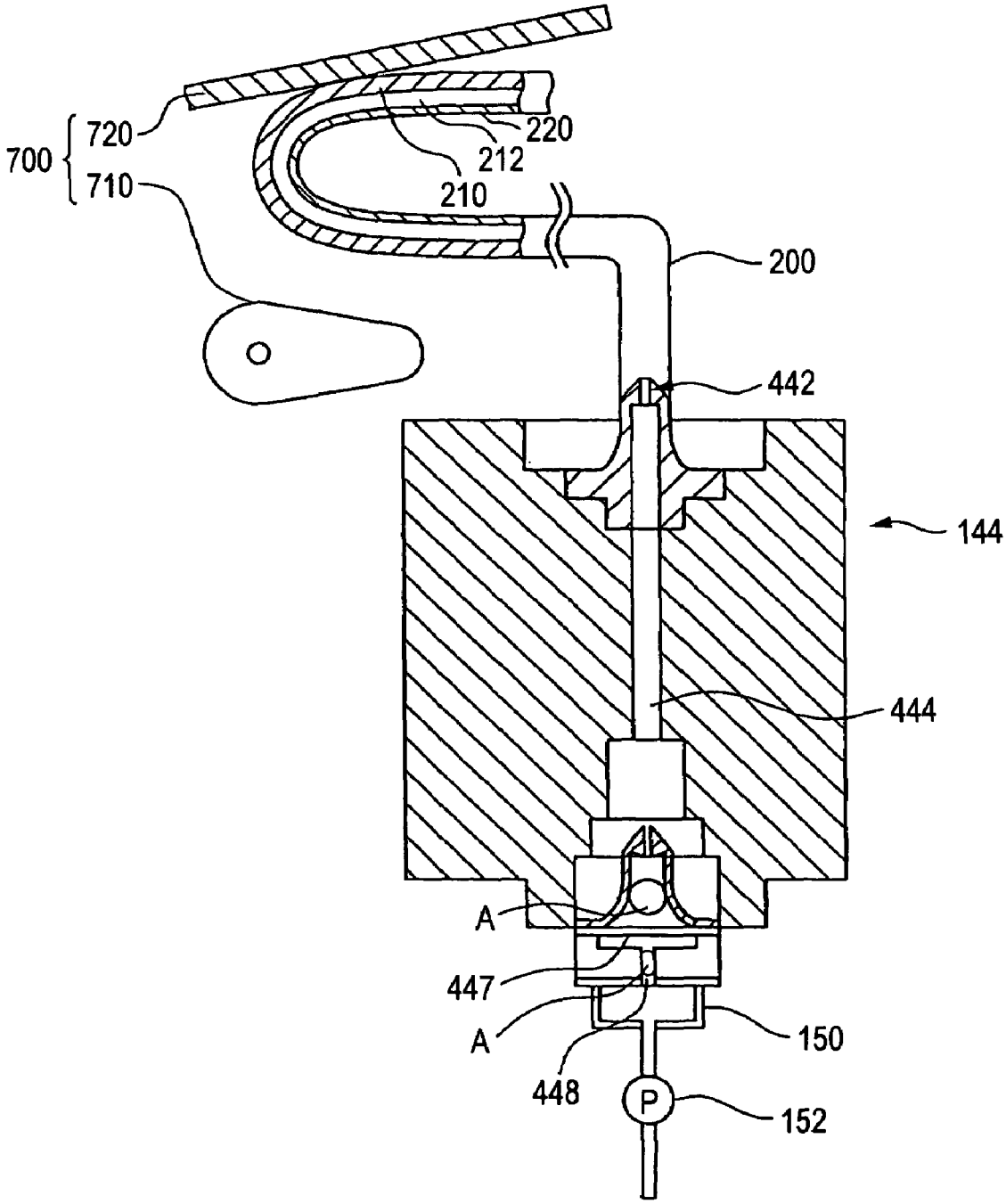

FIGS. 41 and 42 show a liquid supplying device incorporating a liquid supplying member 200 according to a nineteenth embodiment of the invention. In this embodiment, a recording head 144 comprises: a needle member 442 to be connected to the liquid supplying member 200; a nozzle orifice 448 from which ink is ejected toward an object 111 (see FIG. 12); a passage 444 for connecting the needle member 442 and the nozzle orifice 448; a filter 447 disposed so as to face the nozzle orifice 448.

The liquid supplying device comprises a cleaning mechanism including: a capping member 450 for sealing the nozzle orifice 448; and a suction pump 452 for sucking ink in the recording head 144 through the sealed nozzle orifice 448.

In the above configuration, air bubbles A tend to grow in the vicinity of the filter 447. In order to discharge the air bubbles A from the nozzle orifice 448, as shown in FIG. 41, an actuator 700 rotates a cam 710 so as to press the liquid supplying member 200 against a frame 720, thereby bending the liquid supplying member 200. Since the elongated plate member 220 has a greater longitudinal elastic coefficient than the base member 210, the elongated plate member 220 is easily so bent as to come in contact with the bottom of the groove 212, thereby closing the liquid supplying passage. After that, the capping member 450 seals the nozzle orifice 448. The suction pump 452 sucks ink in the recording head 144 from the nozzle orifice 448 while the liquid supplying passage is closed. Since the ink pressure in the passage between the nozzle orifice 448 and the bent part of the liquid supplying member 200 is lowered, the air bubbles A are expanded by the negative pressure, so that a part of them penetrate the filter 447 toward the nozzle orifice 448.

Subsequently, as shown in FIG. 42, the actuator 700 releases the bending of the liquid supplying member 200 while the suction pump 452 keeps sucking the interior of the capping member 450. As the liquid supplying member 200 is elastically restored to its original state, the liquid supplying passage is opened, so that ink is sucked from the nozzle orifice 448 by the suction pump 152. Due to the release of the negative pressure, the flow speed of ink is relatively increased in comparison with a case where the liquid supplying member 200 is not bent. Accordingly, the air bubbles A stayed in the vicinity of the filter 447 (at least the bubbles penetrating the filter 447) is discharged from the nozzle orifice 448 together with ink.

The above-described cleaning operation may be performed for other purpose than the discharge of the air bubbles. For example, it may be performed when an ink cartridge 145 is initially mounted in the ink jet recording apparatus and the passage 444 is filled with ink at the first time, or when ink in the passage 444 becomes viscous due to the non-use of the ink jet recording apparatus for a long time period.

With the above configuration, the ink supplying passage can be opened or closed by the simple mechanism without providing a valve in the liquid supplying member 200.

In the above embodiments, the ink jet recording apparatus (printing apparatus including facsimile, copier and the like) for ejecting ink is exemplified as the liquid ejection apparatus. The liquid ejection apparatus may eject another kind of liquid, as a matter of course. Examples of such apparatus is a liquid ejection apparatus for jetting liquid, e.g., electrode material or colorant, used in manufacturing LCD devices, EL display devices, FET (field emission display) devices, a liquid ejection apparatus for ejecting organic material used in manufacturing biological biochips, and a test sample ejection apparatus as an accurate pipette.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid supplying member, for supplying liquid from a liquid container to a liquid ejection head which are provided in a liquid ejection apparatus, the liquid supplying member comprising:

a flexible base member, having a first face in which a plurality of first grooves are arrayed in a first direction; and a first flexible plate member, joined to the first face of the base member so as to seal the first grooves to form liquid supplying passages, through which the liquid is supplied from the liquid container to the liquid ejection head, wherein the base member has a first thickness, and the first plate member has a second thickness thinner than the first thickness.

2. The liquid supplying member as set forth in claim 1, wherein each of the first grooves is formed with a through hole extending to a second face of the base member which is opposite to the first face.

3. The liquid supplying member as set forth in claim 2, further comprising a second flexible plate member which is joined to a part of the second face and comprised of a metal layer.

4. The liquid supplying member as set forth in claim 2, wherein:

the second face of the base member is formed with a plurality of second grooves arrayed in the first direction and sealed by a second flexible plate member.

5. The liquid supplying member as set forth in claim 4, wherein each one of the first grooves is communicated with associated one of the second grooves.

6. The liquid supplying member as set forth in claim 4, wherein each of the second grooves is formed with a through hole extending to the first face.

7. The liquid supplying member as set forth in claim 1, wherein the base member is comprised of thermoplastic elastomer.

8. The liquid supplying member as set forth in claim 7, wherein:

the thermoplastic elastomer is comprised of polypropylene; and the first plate member comprises a first layer which is joined to the first face of the base member and comprised of at least one of polypropylene and polyethylene.

9. The liquid supplying member as set forth in claim 8, wherein the first plate member comprises a second layer comprised of metal.

10. The liquid supplying member as set forth in claim 9, wherein the first plate member comprises a third layer comprised of polyamide and a fourth layer comprised of polyethylene terephthalate, between which the second layer is sandwiched.

11. The liquid supplying member as set forth in claim 1, wherein:

the liquid supplying member comprises a first portion to be flexed and a second portion not to be flexed; and the first portion has a first thickness and the second portion has a second thickness thicker than the first thickness.

12. The liquid supplying member as set forth in claim 1, wherein:

the liquid supplying member comprises a first portion to be flexed and a second portion not to be flexed; and a portion of the base member corresponding to at least the first portion has a cross section curved in a direction that the liquid supplying member is to be flexed.

13. The liquid supplying member as set forth in claim 1, further comprising a connector having a higher rigidity than the base member and communicating the first grooves and the liquid ejection head.

14. The liquid supplying member as set forth in claim 13, wherein the connector and the base member are monolithically formed.

15. The liquid supplying member as set forth in claim 1, wherein a cross-sectional area of each of the first grooves is partly changed.

16. The liquid supplying member as set forth in claim 15, wherein the base member includes a first portion that an extending direction of the liquid supplying member is changed, and the cross-sectional area is reduced at the first portion.

17. The liquid supplying member as set forth in claim 15, wherein:

the base member includes a first portion in which the cross-sectional area is enlarged so as to temporarily store liquid supplied from the liquid container; and a detector, disposed at the first portion to detect that an amount of ink remaining in the first portion is a predetermined level or less.

18. The liquid supplying member as set forth in claim 1, wherein the base member is curved such that both longitudinal ends are opposed to each other in the vicinity of a longitudinal center portion thereof, in an original state.

19. A liquid ejection apparatus in which the liquid supplying member as set forth in claim 1 is extended from the liquid container to the liquid ejection head.

20. The liquid ejection apparatus as set forth in claim 19, wherein the liquid supplying member is flexed such that either the base member or the first plate member having a higher elasticity than the other faces inwards.

21. The liquid supplying member as set forth in claim 1, wherein a thickness of the first plate member is substantially identical with a thickness of the base member.

22. The liquid supplying member as set forth in claim 1, further comprising a second flexible plate member, having a thickness which is identical with a thickness of the base member and joined to a face of the first plate member which is opposite to the face to which the base member is joined, wherein the first plate member is comprised of a metal layer.

23. The liquid supplying member as set forth in claim 1, further comprising a second flexible plate member, having a second face in which a plurality of second grooves are arrayed in the first direction, wherein a face of the first plate member opposite to a face joined to the base member is joined to the second face of the second plate member so as to seal the second grooves.

24. The liquid supplying member as set forth in claim 1, wherein a part of the base member is branched such that each of branched portion includes at least one of the first grooves.

25. The liquid supplying member as set forth in claim 1, wherein a longitudinal elastic coefficient of the first plate member is higher than a longitudinal elastic coefficient of the base member.

26. The liquid supplying member as set forth in claim 1, wherein parts of the first plate member facing the first grooves are flat.

27. A method of manufacturing a liquid supplying member for supplying liquid from a liquid container to a liquid ejection head provided in a liquid ejection apparatus, the method comprising steps of:

providing a mold for forming a base member having a first face in which a plurality of first grooves are arrayed in a first direction;

injecting molten thermoplastic elastomer into the mold to form the base member having a flexibility; and joining a flexible plate member to the first face of the base member so as to seal the first grooves to form liquid supplying passages, wherein the base member has a first thickness, and the first plate member has a second thickness thinner than the first thickness.

28. The manufacturing method as set forth in claim 27, wherein:

the mold is configured such that the base member is curved such that both longitudinal ends are opposed to each other in the vicinity of a longitudinal center portion thereof; and the thermoplastic elastomer is injected from portions of the mold corresponding to the both longitudinal ends and the longitudinal center portion.

29. The method as set forth in claim 27, wherein parts of the first plate member facing the first grooves are flat.

* * * * *